US005378427A

United States Patent [19]

Otsuka et al.

[11] Patent Number: 5,378,427

[45] Date of Patent: Jan. 3, 1995

[54] CORROSION-RESISTANT ALLOY HEAT TRANSFER TUBES FOR HEAT-RECOVERY BOILERS

[75] Inventors: Nobuo Otsuka, Nishinomiya; Takeo Kudo, Nishinomiyashi, both of Japan

[73] Assignee: Sumitomo Metal Industries, Ltd., Osaka, Japan

[21] Appl. No.: 147,441

[22] Filed: Nov. 5, 1993

Related U.S. Application Data

[63] Continuation of Ser. No. 850,528, Mar. 13, 1992, abandoned.

[30] Foreign Application Priority Data

| | | | |
|---|---|---|---|
| Mar. 13, 1991 | [JP] | Japan | 3-048133 |
| Jul. 29, 1991 | [JP] | Japan | 3-188567 |
| Nov. 26, 1991 | [JP] | Japan | 3-310384 |
| Jan. 22, 1992 | [JP] | Japan | 4-008941 |
| Jan. 22, 1992 | [JP] | Japan | 4-009052 |

[51] Int. Cl.[6] ..... C22C 30/00

[52] U.S. Cl. ..... 420/586.1; 420/586; 148/909

[58] Field of Search ..... 420/40, 586.1, 585, 420/586; 148/909

[56] References Cited

U.S. PATENT DOCUMENTS

| | | | |
|---|---|---|---|
| 4,443,406 | 4/1984 | Sukekawa et al. | 420/586.1 |
| 4,530,720 | 1/1985 | Moroishi et al. | 420/586.1 |
| 4,765,957 | 8/1988 | Culling | 420/586.1 |
| 4,892,704 | 1/1990 | Sawaragi | 420/59 |

OTHER PUBLICATIONS

Fort et al., "Chlorinated Waste Incinerator Heat Recovery Boiler Corrosion", *Corrosion 85*, Paper 12, Boston, Mass., Mar. 1985.

Chou et al., "High Temperature Corrosion of Tube Support and Attachment Materials for Refuse-Fired Boilers", *The American Soc. of Mech. Eng.*, Jt. ASMEE/IEEE Power Generation Conf. Milwaukee, Wis. Oct. 1985.

Harris et al., "Field Experience of High Nickel Containing Alloys in Waste Incinerators", *Corrosion 87*, Paper No. 402, San Francisco, Calif., Mar. 1987.

P. Ganesan et al., "Experience with Nickel Containing Alloys in Applications in Waste Incinerators", *Industrial Heating*, Dec. 1987.

Whitlow et al., "Combustor and Superheater Material Performance in a Municipal Solid Waste Incinerator", *Corrosion 89*, Paper No. 204, New Orleans, La., Apr. 1989.

Jenkins, "Investigation of High-Temperature Corrosion in an Incinerator Offgas System", *Corrosion 89*, Paper No. 206, New Orleans, La., Apr. 1989.

Lai, "A New Ni-Co-Cr-Fe-Si Alloy for High Temperature, Hostile Environments", *Corrosion 89*, Paper No. 209, New Orleans, La., Apr. 1989.

Corbett et al., "Corrosion Testing of High Chromium Alloys in Simulated Waste Environments", *Corrosion 89*, Paper No. 550, New Orleans, La., Apr. 1989.

*Primary Examiner*—Deborah Yee

*Attorney, Agent, or Firm*—Burns, Doane, Swecker & Mathis

[57] ABSTRACT

A corrosion-resistant austenitic alloy suitable for use in heat transfer tubes for heat-recovery boilers which withstands uniform corrosion, intergranular corrosion, and stress corrosion cracking in refuse-fired boilers and black-liquor combustion boilers. The alloy consists essentially, on a weight basis, of C: not more than 0.05%, Si: not more than 4%, Mn: not more than 7.5%, Ni: 25-55%, Cr: more than 20% and not more than 35%, Mo: an amount satisfying the following inequality (1) when $Mn(\%) \leqq 2.5$ or inequality (2) when $2.5 \leqq Mn(\%) \leqq 7.5$, $$Mo(\%) \leqq 5.8 - [Ni(\%)/10] \quad (1)$$

$$Mo(\%) \leqq 7.5 - [Ni(\%)/10] \quad (2)$$

optionally one or more of Nb, Ti, Zr, and V: 0.1-3% in total, one or more of Cu, Co, and W: 0.1-5% in total, N: 0.1-0.3%, Al: not more than 0.5%, and at least one rare earth metal: 0.01-0.1% in total, and the balance of Fe and incidental impurities in which the content of P is not more than 0.030% and that of S is not more than 0.010%.

27 Claims, 1 Drawing Sheet

Fig. 1(A)
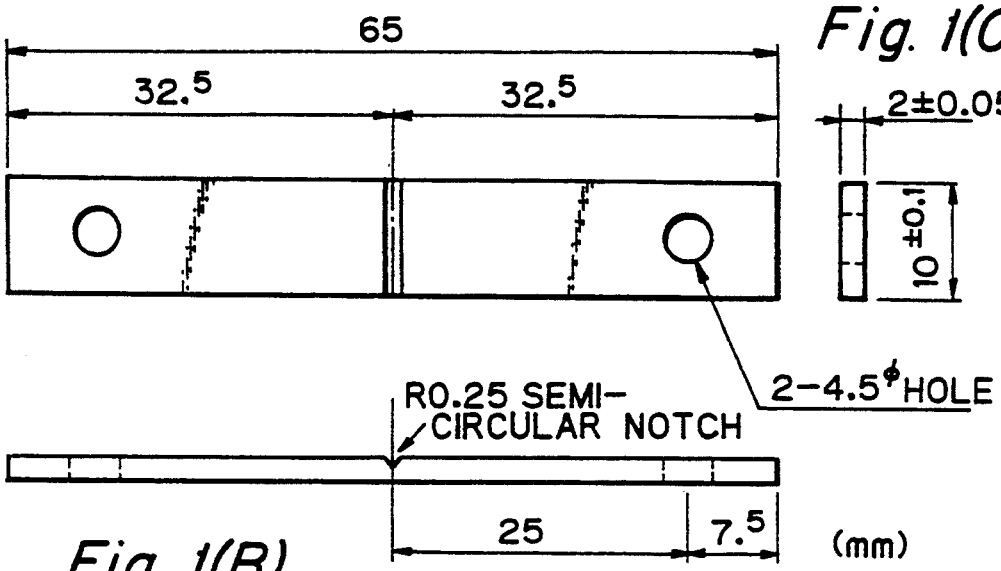
Fig. 1(C)
Fig. 1(B)
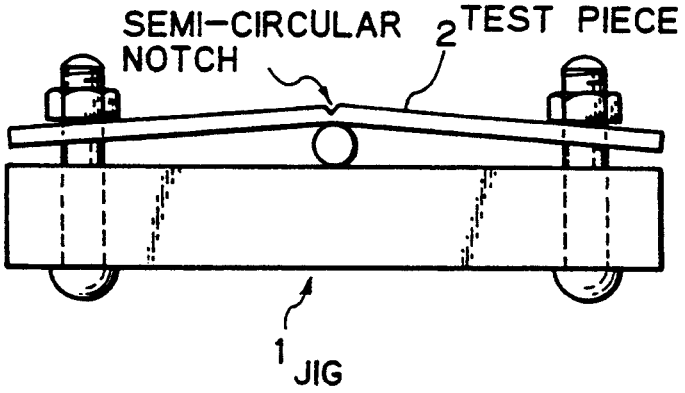
Fig. 2

CORROSION-RESISTANT ALLOY HEAT TRANSFER TUBES FOR HEAT-RECOVERY BOILERS

This application is a continuation of application Ser. No. 07/850,528, filed Mar. 13, 1992 now abandoned.

BACKGROUND OF THE INVENTION

This invention relates to a corrosion-resistant alloy for use in heat transfer tubes (boiler tubes) for heat-recovery boilers which are used in a high-temperature corrosive environment where chloride-containing fuel ash condensates are deposited on the surface of boiler tubes.

More particularly, the present invention is concerned with an austenitic high-Cr, high-Ni alloy which is particularly useful in a high-temperature corrosive environment and which is suitable for use in boiler heat transfer tubes such as superheater tubes, reheater tubes, evaporator tubes, and water-wall tubes for heat-recovery boilers installed in facilities for incinerating municipal refuse, industrial waste, sewage sludge, and the like (hereinafter referred to collectively as refuse) for energy recovery, black-liquor combustion boilers installed in paper factories, and other heat-recovery boilers.

Recently there has been much interest in utilizing energy of municipal refuse because it can take full advantage of the potential energy of waste materials. In fact, power generation by incinerating municipal refuse has already been performed in some municipal incinerators for internal use and for electricity supply to utilities. Also in the paper industry, black-liquor combustion boilers have been used for firing black liquor formed as a by-product in a pulping process in order to recover soda and generate electric power using the waste heat of combustion.

To maximize the efficiency of electricity generation in the above-described heat-recovery system, it is desirable to increase the temperature .and pressure of the steam. However, an increase in steam temperature results in an increase in the metal temperature of the boiler tubes, thereby accelerating corrosion of the tubes. An increase in steam pressure requires a material which has an improved high-temperature strength. Heat-recovery boilers presently used in municipal waste incinerators are predominantly those operated such that the metal temperature of superheater tubes is around 800°-900° F. However, it is expected that operating conditions with a higher metal temperature of superheater tubes which exceeds 900° F. will be employed in the near future in heat-recovery boilers for refuse incinerators (hereinafter referred to as refuse-fired heat-recovery boilers), as is the case in black-liquor combustion boilers, in order to improve the power generation efficiency.

Since municipal refuse includes a large amount of plastics, the exhaust gas upon incineration of municipal refuse contains a considerable amount of hydrogen chloride. The fuel ash condensates (fuel slag in the form of fused salt) which are the residues of incineration also contain chloride compounds. Therefore, the metallic material of heat transfer tubes used in refuse-fired heat-recovery boilers suffers not only corrosion resulting from gaseous attack by hydrogen chloride but also corrosion induced by deposition thereon of chloride-containing fused fuel slags (so-called "hot corrosion"). These types of corrosion become serious problems in refuse-fired heat-recovery boilers. The same problems are also found in boiler tubes for black-liquor combustion boilers, since they are attacked by $SO_2$-containing combustion gases and chloride-containing fuel ash condensates, which are both corrosive.

Under the above-described circumstances, there is a need for a material for heat transfer tubes which has good high-temperature strength and improved corrosion resistance sufficient to withstand these severe corrosive environments at high temperatures.

Corrosion-resistant steels or alloys of austenitic phases which are known to have excellent high-temperature strength are desirable for use in high-temperature boiler tubes such as superheater tubes for heat-recovery boilers operated at high temperatures and high pressures.

Various materials of austenitic phases have been investigated in the United States for use in heat-recovery boiler tubes for municipal incinerators. For example, it is reported in Corrosion 87, Mar. 9-13, 1987, Paper No. 402 that tubes of Incoloy Alloy 825 (which corresponds to alloy NO8825 specified in ASTM B163 and B423) containing about 42% Ni, 22% Cr, and 3% Mo by weight were actually used as heat-recovery boiler tubes in a commercial municipal incinerator. According to that article, the high-Ni alloys exhibited improved corrosion resistance with minimum tube thinning caused by corrosion in high-temperature corrosive environments normally encountered in municipal incinerators in the United States.

Other articles dealing with corrosion of commercially-available conventional austenitic high-alloy steels in the above-described high-temperature corrosive environments include Corrosion 85, Mar. 25-29, 1985, Paper No. 12; Corrosion 89, Apr. 17-21, 1989, Papers Nos. 204, 206, 209, and 550; and P. Ganesan et al, Industrial Heating, December 1987, pp. 18-22. In "High-Temperature Corrosion of Tube Support and Attachment Materials for Refuse-Fired Boilers" by S. F. Chou et al, Proceedings of the 1985 ASME IEEE Power Generation Conference, Milwaukee, Oct. 20-24, 1985, various alloys including Incoloy Alloy 825 and Carpenter Alloy 20Cb-3 which contains 34.0% Ni, 2.5% Co, 20.0% Cr, and 2.0% Mo were tested for corrosion as a tube support and attachment material for refuse-fired heat-recovery boilers. These articles generally discuss uniform corrosion of austenitic high-alloy materials at very high temperatures in the range of 1100°-1700° F.

However, the maximum metal temperature of superheater tubes for refuse-fired heat-recovery boilers is estimated to be 1000° F. at the highest. As described above, these boiler tubes are exposed to very severe corrosive conditions since they are attacked by chloride-containing fuel ash condensates deposited thereon in a hydrogen chloride-containing gas atmosphere. Therefore, it is necessary for such heat transfer tubes to have resistance not only to uniform corrosion but also to intergranular corrosion attack (which occurs preferentially at grain boundaries) in the temperature range of about 700°-1000° F. in the above-described environment. Furthermore, it is important that these tubes withstand stress corrosion cracking in such an environment, particularly in portions such as welded joints and bends where stresses are concentrated.

The present inventors investigated corrosion of various conventional austenitic alloys in the above-described high-temperature corrosion environment, including chloride-containing corrosive fused salts on the test materials as encountered in refuse-fired waste heater boilers and black-liquor combustion boilers. As a result, it was found that most of conventional high-Cr, high-Ni austenitic alloys such as Incoloy Alloy 825 have high susceptibility to stress corrosion cracking as well as uniform corrosion and intergranular corrosion under such conditions. Since boiler tubes are pressure vessels used at high temperatures and high pressures, it becomes a serious problem that conventional alloys are considerably susceptible to stress corrosion cracking in stress-concentrated portions such as weld joints and bends. This indicates a possibility of corrosion failure of tubes caused by stress corrosion cracking, and such a failure may lead to shutdown of an entire incineration plant. Therefore, it is important that a corrosion-resistant material for boiler tubes have good resistance to stress corrosion cracking.

SUMMARY OF THE INVENTION

It is an object of the present invention to provide a material for heat transfer tubes used in heat-recovery boilers which can satisfactorily withstand a high-temperature corrosive environment encountered in refuse-fired heat-recovery boilers or black-liquor combustion boilers without the above-mentioned problems of conventional austenitic steels and alloys.

It is another object of the invention to provide such austenitic steels and alloys which exhibit improved high-temperature strength and improved resistance to stress corrosion cracking, uniform corrosion, and intergranular corrosion at high temperatures up to 1000° F. in the above-described corrosive environments.

The present invention provides a corrosion-resistant alloy suitable for use in heat transfer tubes for heat-recovery boilers, which consists essentially, on a weight basis, of

| | |
|---|---|
| C: not more than 0.05%, | Si: not more than 4%, |
| Mn: not more than 7.5%, | Ni: 25–55%, |
| Cr: more than 20% and not more than 35%, | |
| Mo: an amount satisfying the following inequality (1) when Mn (%) ≦ 2.5 or inequality (2) when 2.5 < Mn (%) ≦ 7.5, | |

$$Mo(\%) \leqq 5.8 - [Ni(\%)/10] \quad (1)$$

$$Mo(\%) \leqq 7.5 - [Ni(\%)/10] \quad (2)$$

optionally one or more of Nb, Ti, Zr, and V: 0.1–3% in total, one or more of Cu, Co, and W: 0.1–5% in total, N: 0.1–0.3%, Al: not more than 0.5%, and at least one rare earth metal: 0.01–0.1% in total, and a balance of Fe and incidental impurities in which the content of P is not more than 0.030% and that of S is not more than 0.010%.

The alloy has an austenitic phase and preferably contains at least 25% by weight of Cr. It is also preferable that the alloy have fine grains with a grain size equal to or smaller than ASTM grain size No. 7.

BRIEF DESCRIPTION OF THE DRAWINGS

FIG. 1(A) is a plan and FIG. 1(B) is a side view and FIG. 1(C) is a cross section showing the shape of a test specimen used in the examples to perform a stress corrosion cracking test in a high-temperature corrosive environment; and FIG. 2 is a side view showing the attachment of the test specimen to a jig used in the stress corrosion cracking test.

DESCRIPTION OF THE INVENTION

The present invention will now be described in detail. In the following description, all percents are by weight as long as they are concerned with an alloy composition.

The austenitic high-Cr, high-Ni alloy of the present invention exhibits improved high-temperature strength and corrosion resistance and is adapted for use as a material for heat transfer tubes for refuse-fired heat-recovery boilers or black-liquor combustion boilers as the overall result of the alloying elements added in optimum proportions. The main bases on which the above alloy composition is selected are as follows.

(a) In corrosive environments encountered in refuse-fired heat-recovery boilers, a high-Ni austenitic alloy is highly susceptible to stress corrosion cracking (hereinafter abbreviated as SCC). However, when it has a Cr content of more than 20% and not more than 35% and an Ni content between 25% and 55%, the susceptibility to SCC of such an alloy is significantly decreased as long as it is substantially free from Mo. It is known in the prior art that Mo serves to decrease the susceptibility to SCC of an austenitic stainless steel observed in an aqueous chloride ion-containing solution such as seawater. This is the reason why the above-described Incoloy Alloy 825, which is a seawater corrosion resistant steel, contains 3% Mo. Contrary to the common belief in the prior art, it was found that the addition of Mo to such a high-Cr, high-Ni alloy in a relatively large amount serves to increase the susceptibility to SCC of the alloy when it is exposed to a high-temperature corrosive environment in which there is deposition of fused salts of chloride-rich condensates, as encountered in refuse-fired heat-recovery boilers.

(b) However, the addition of Mo is required in order to increase the resistance to intergranular corrosion of a high-Cr, high-Ni alloy. Upon further investigations, the present inventors found that the susceptibility to SCC of an Mo-containing high alloy depends on the relative amounts of Ni and Mo and that the susceptibility to SCC can be decreased while maintaining the required resistance to intergranular corrosion attack by controlling the Mo content to a value corresponding to {5.8—[Ni(%)/10]} or lower.

(c) Mn serves to stabilize the austenitic phase and is also effective for improving resistance to uniform corrosion in a high temperature range without adversely affecting the resistance to SCC. In an Mo-containing alloy, the addition of Mn rather decreases the susceptibility to SCC. As a result, when the alloy contains a relatively large amount of Mn, i.e., when the Mn content is higher than 2.5%, the maximum Mo content sufficient to decrease the SCC susceptibility can be increased. Thus, in this case, a decreased susceptibility to SCC can be achieved by controlling the Mo content to a value corresponding to {7.5—[Ni(%)/10]} or lower.

(d) The addition of Si to an austenitic alloy results in a significant improvement in resistance to uniform corrosion in a high-temperature corrosive environment. The addition of one or more of Cu, Co, and W to such an Si-containing alloy serves to increase the high-temperature strength of the alloy. The addition of one or more of Nb, Ti, Zr, and V to an austenitic alloy serves to stabilize carbon dissolved in the alloy, thereby preventing a decrease in strength at high temperatures.

Accordingly, one or more of these elements may optionally be added, if necessary.

(e) It has been considered that intergranular corrosion of an austenitic alloy in the above-described corrosive environments is caused by chromium carbide precipitated at grain boundaries of the alloy through the following two mechanisms: (i) reaction of the chromium carbide precipitates with fused salts of chloride-containing slags and (ii) preferential corrosion of the Cr-depleted zone formed around the chromium carbide precipitates.

However, in an experiment performed under such conditions that a chloride-containing corrosive fused salt deposited on the test specimens, the present inventors found that even an alloy in which chromium carbide was not considerably precipitated suffered intergranular corrosion attack. As a result of further investigation, it was found that intergranular corrosion also proceeds through preferential dissolution of impurity elements segregated at grain boundaries into the fused salt deposits.

Based on this finding, the alloy composition in which the contents of Cr, Ni, and Mo are selected as described above is restricted to $C \leqq 0.05\%$, $P \leqq 0{,}030\%$, and $S \leqq 0.010\%$ in order to improve the resistance to intergranular corrosion of the alloy.

It has also been found that intergranular corrosion can be eliminated substantially completely under the above-described corrosive conditions by reducing the grain size of the alloy. It is considered that such grain refinement increases the surface area of grain boundaries and hence decreases the amount of impurities segregated per unit area of grain boundaries, thereby decreasing dissolution of the segregated impurities into the fused slag and suppressing intergranular corrosion.

The reason for restricting the content of each element in the corrosion resistant alloy of the present invention is as follows.

C (carbon):

Carbon combines with Cr in the alloy to precipitate as massive chromium carbide, which reacts with chloride-containing fused salts deposited on the surface of the alloy or forms Cr-depleted zones in the vicinity of grain boundaries, thereby decreasing the resistance to intergranular corrosion of the alloy. Therefore, the carbon content should be as low as possible. The maximum acceptable carbon content is 0.05%. Preferably, the C content is not more than 0.03%.

Si (silicon):

Silicon is necessary as a deoxidizer and is generally effective for improving oxidation resistance. In an austenitic alloy, the addition of Si in a relatively large amount serves to suppress uniform corrosion and impart improved corrosion resistance to the alloy, particularly when the alloy is exposed to an environment in which chloride-containing fused salts deposit on the surface of the alloy at high temperatures in the range of 700°–1000° F. However, the addition of Si in excess of 4% causes sigma-embrittlement of the alloy. Therefore, the maximum Si content is 4%.

Since the susceptibility of the alloy to cracking at high temperatures in welded joints increases with increasing Si content, it is preferred that the Si content be not more than 2% in order to ensure that the alloy has good weldability desirable for boiler tube application. When the alloy contains 25% or more of Cr, the requisite high-temperature strength and resistance to uniform corrosion can be assured by the addition of such a large amount of Cr along with Ni, so the Si content may be greatly decreased to 0.3% or less, whereby the resistance to intergranular corrosion of the alloy is improved. Mn (manganese):

Manganese is an austenite former and also serves as a deoxidizer. The addition of Mn is effective for improving resistance to uniform corrosion, particularly in an environment where chloride-containing fused salts deposit on the surface of the alloy at high temperatures in the range of 700°–1000° F. In order to positively attain such effect, Mn may be added in an amount as large as more than 2.5%. However, the addition of Mn in excess of 7.5% causes degradation in oxidation resistance and hot workability. Therefore, the maximum Mn content is 7.5%. In order to ensure that the alloy has good oxidation resistance and hot workability, it is preferred that the Mn content be 2.5% or less.

Cr (chromium):

The addition of chromium is highly effective for improving strength and oxidation resistance at high temperatures. For this purpose, it is necessary to add more than 20% Cr, since resistance to oxidation and to uniform corrosion at high temperatures is not improved sufficiently at an Cr content of 20% or less.

However, in a high-temperature corrosive environment in which there is deposition of chloride-containing fused salts as encountered in refuse-fired heat-recovery boilers, an excessive increase of Cr content does not result in an appreciable improving effect on corrosion resistance. Particularly, when the Cr content exceeds 35%, chromium oxide formed on the surface of the alloy which inherently exhibits a protecting effect begins to react with chlorides in the fused salts to form volatile $Cr_2O_2Cl_2$, thereby degrading the resistance of the alloy to corrosion at high temperatures, even though it contains significant amounts of corrosion resistance-improving elements such as Ni and Mo. The addition of an excessively large amount of Cr is also disadvantageous from the viewpoint of economy.

Therefore, the Cr content is more than 20% and not more than 35%, preferably in the range of 25–35% and more preferably in the range of 25–30%.

Ni (nickel):

Nickel is an austenite former and is an essential element in order to ensure that the alloy has good high-temperature strength and to suppress uniform corrosion mainly caused by chloride-containing corrosive fuel slags. Since Ni is expensive, the maximum Ni content is determined to be 55% in view of a balance between the material costs and the above effects of Ni. The minimum Ni content is 25% for the reason that the resistance to corrosion at high temperatures rapidly decreases when the Ni content decreases to less than 25%. Preferably the Ni content is in the range of 30–50% and more preferably 35–45%.

Mo (molybdenum):

Molybdenum is known to improve corrosion resistance, particularly resistance to SCC in an aqueous $Cl^-$-containing solution and may be added to corrosion-resistant alloys usually in order to improve corrosion resistance in aqueous corrosion environments. As described above, however, in a high-temperature corrosive environment which includes deposition of fused fuel slags which contain chlorides in a high concentration as encountered in refuse-fired heat-recovery boilers, the addition of Mo in a large amount increases the susceptibility to SCC. Nevertheless, it is desirable to add Mo in a proper amount since Mo serves to strengthen grain boundaries of the alloy, thereby increasing the resistance to intergranular corrosion attack.

As described previously, it has been found that the effect of Mo on susceptibility to SCC greatly depends on the Ni content of the alloy and also depends on its Mn content. Thus, when the Mn content is 2.5% or less, it is necessary to add Mo in an amount which satisfies the following inequality (1) in order to protect the alloy from intergranular corrosion attack without a significant increase in susceptibility to SCC.

$$Mo(\%) \leqq 5.8 - [Ni(\%)/10] \quad (1)$$

When the Mn content is more than 2.5%, the susceptibility to SCC decreases due to the presence of such a large amount of Mn. In this case, therefore, the addition of a greater amount of Mo which satisfies the following inequality (2) is acceptable.

$$Mo(\%) \leqq 7.5 - [Ni(\%)/10] \quad (2)$$

In order to ensure that intergranular corrosion is suppressed by the effect of Mo, it is preferred that Mo be added in an amount of at least 0.3% when the Mn content is not more than 2.5% or at least 0.5% when the Mn content is more than 2.5% and not more than 7.5%.

The following elements may optionally be added to the alloy of the present invention. Nb (niobium), Ti (titanium), Zr (zirconium), and V (vanadium):

These alloying elements are hereinafter referred to as Group A elements. Each of Nb, Ti, Zr, and V tends to form a carbide so that it serves to fix carbon dissolved in the alloy and suppress the precipitation of chromium carbide, thereby providing the alloy with improved high-temperature strength and increased resistance to intergranular corrosion attack. In a boiler tube of an austenitic alloy, a reaction of chromium carbide precipitated at grain boundaries with chloride-containing fused slags deposited on the surface of the tube is one of the reasons for which intergranular corrosion is caused. Therefore, the addition of one or more Group A elements to an alloy in which the contents of C, P, and S are minimized enables the alloy to have a still improved resistance to intergranular corrosion attack. This effect is not significant when the total content of Group A elements is less than 0.1%, and is saturated with increasing material costs when it is more than 3%. Therefore, if necessary, one or more Group A elements may optionally be added in a total amount of 0.1–3% and preferably 0.1–1%.

Cu (copper), Co (cobalt), and W (tungsten):

These alloying elements are hereinafter referred to as Group B elements. Each of Cu, Co, and W has a solid-solution strengthening effect and serves to increase the high-temperature strength of the alloy. Like Group A elements, one or more Group B elements may optionally be added, as required. The effect of Group B elements is not significant when the total content thereof is less than 0.1%, and is saturated with increasing material costs when it is more than 5%. Therefore, when added, the total content of one or more Group B elements is in the range of 0.1–5% and preferably 2–5%.

REM (Rare Earth Metals):

Rare earth metals such as Y (yttrium), La (lanthanum), and Ce (cerium) serve to improve the adhesion of protective oxide films ($Cr_2O_3$ or $SiO_2$) formed on the surface of the alloy. When such effect is desired, one or more rare earth metals can be added in a total amount of at least 0.01%. However, the addition of REM in excess of 0.1% in total causes the alloy to have degraded hot workability. Therefore, when added, the REM content is in the range of 0.01–0.1% and preferably 0.02–0.06%.

N (nitrogen):

Nitrogen serves to stabilize the austenitic phase of the alloy and increase its high-temperature strength. For this purpose, N may be added in an amount of 0.1% or more, if necessary. It is difficult for the alloy composition of the present invention to add more than 0.3% N by a conventional melting technique. Therefore, when added, the N content is between 0.1% and 0.3% and preferably between 0.1% and 0.2%.

Al (aluminum):

Aluminum may be optionally added in order to accelerate the deoxidation of the alloy and improve the hot workability thereof. However, if the amount of Al which remains dissolved in the alloy exceeds 0.5%, boiler tubes of the alloy will cause precipitation of an intermetallic compound ($Ni_3Al$) during a long-term service at high temperatures, thereby adversely affecting the creep ductility. Therefore, when added, the content of aluminum (sol. Al) is preferably at most 0.5% and more preferably at most 0.2%.

The remainder of the alloy of the present invention consists essentially of Fe and incidental impurities. In the incidental impurities, the contents of P and S are restricted to at most 0.030% and at most 0.010%, respectively. The presence of P or S in excess of their respective maximum acceptable contents results in a decreased resistance to intergranular corrosion attack.

The high-Cr, high-Ni alloy of the present invention may be prepared, for example, by melting in an electric furnace followed by refining by the VOD or AOD process and a billet is produced from the resulting alloy by a conventional process. The billet is then subjected to hot extrusion to produce a parent tube, from which a tube of the predetermined final dimensions is formed by cold drawing. Thereafter, the tube is subjected to heat treatment for solutioning. The heat treatment may be performed according to the conventional solution treatment process by heating to 1900°–2200° F. followed by rapid cooling. However, in order to attain grain refining, it is preferred to effect the heat treatment in a lower temperature region, i.e, by solution treatment which is performed by heating to 1750°–1900° F. followed by rapid cooling. As a result, a fine grain size equal to or smaller than ASTM grain size No. 7 is attained in the alloy and the resistance of the alloy to intergranular corrosion attack is further improved. For this purpose, it is more preferable that the alloy have a grain size equal to or smaller than ASTM grain size No. 8.

Alternatively, in the case of an Nb-containing alloy, a billet of such an alloy may be heated to a higher temperature in the range of 2200°–2400° F. so as to completely dissolve carbides as solid solutions before it is hot-extruded into a parent tube. The parent tube is then worked at a relatively high working ratio on the order of 30% to form the final tube shape. In this case the subsequent heat treatment may be effected by solution treatment which is performed by heating to 1900°–2300° F. followed by rapid cooling, thereby enabling the dissolved carbides to precipitate so as to form fine grains of the above-described desirable size.

After the heat treatment, the tube is finally descaled to give a heat transfer tube product. The resulting tube made of the alloy of the present invention may be used in the form of a clad or double tube combined with a tube of a different material.

The alloy according to the present invention has good resistance to uniform corrosion and significantly improved resistance to stress corrosion cracking and intergranular corrosion attack in corrosive environments to which refuse-fired heat-recovery boilers and black-liquor combustion boilers are exposed and in which there is deposition of chloride-containing fused salts on the tubes. Due to the austenitic structure, the alloy has good high-temperature strength and is improved in workability and weldability. Another advantage is that it is less expensive than conventional Ni-based corrosion-resistant alloys since the Ni content is relatively low (55% at most).

The use of heat transfer tubes made of the alloy of the present invention in high-temperature sections within a heat-recovery boiler of the above-described type, for example, as superheater tubes, enables the boiler to be operated at a higher temperature and a higher pressure, leading to better use of waste heat, compared to the use of tubes of conventional austenitic alloys. As a result, it becomes possible to transform the waste heat into electricity with improved efficiency of energy recovery.

The following examples are presented to further illustrate the present invention. These examples are to be considered in all respects as illustrative and not restrictive.

EXAMPLE 1

This example illustrates inventive alloys each having a relatively low Mn content of not more than 2.5% and an Mo content satisfying the above inequality (1).

Various alloys according to the present invention (hereinafter referred to as inventive alloys) each having a weight of 17 kg and a composition shown in Table 1 were prepared by melting in a vacuum remelting furnace and casting into ingots. Each ingot was heated to 2000° F. (1100° C.) and worked by hot forging and then hot rolling to form a 15 mm-thick billet. The billet was subjected to softening heat treatment at 2000° F. and then cold-rolled into a 10.5 mm-thick plate. Thereafter, the plate was subjected to solution treatment by heating at 2200° F. (1200° C.) followed by water cooling.

Corrosion test specimens of 2 mm thick×10 mm wide×10 mm long and stress corrosion cracking test specimens having the shape and dimensions shown in FIGS. 1(A) and 1(B) were cut out from each solution-treated alloy plate in the center area thereof and subjected to a high-temperature corrosion test and a stress corrosion cracking test, respectively, both simulating typical corrosive environments encountered in a refuse-fired heat-recovery boiler.

For comparison, comparative alloys having compositions outside the range defined herein were prepared and test specimens were made in the same manner as described above. Using commercially-available boiler tubes as conventional alloys, test specimens of the above-described two types having the same dimensions as above were cut out from each of these tubes in the center portion along its thickness. These test specimens of comparative and conventional alloys were also subjected to the high-temperature corrosion test and stress corrosion cracking test. In the conventional alloys shown in Table 1, Alloy No. 63 corresponds to NO 8825 alloy defined in ASTM B163; Alloy No. 64, to TP 304; Alloy No. 65 to TP 316L; Alloy No. 66, to TP 310; and Alloy No. 67, to NO 8320 alloy defined in ASTM B622.

The high-temperature corrosion test was performed by applying a synthetic ash having a composition, by mole %, of 10% NaCl-10% KCl-15% $FeCl_2$-15% $PbCl_2$-18.75% $Na_2SO_4$-18.75% $K_2SO_4$-12.5% $Fe_2O_3$ to opposite surfaces of each test specimen in an amount of 30 mg/cm$^2$ and heating the ash-applied test specimen for 20 hours at a temperature of 1022° F. (550° C.) in a gas stream having a composition of 0.15% HCl-300 ppm $SO_2$-7.5% $O_2$-7.5% $CO_2$-20% $H_2O$-balance $N_2$.

The corrosion resistance (resistance to uniform corrosion) was evaluated by weighing the test specimen after it had been descaled and determining the weight loss based on the weights of the test specimen before and after the test.

The resistance to intergranular corrosion attack was evaluated by observing a cross section of surface area of the descaled, corroded test specimen under a 100X optical microscope to determine the maximum depth of penetration (maximum penetration) of intergranular corrosion by sectional micrography.

The stress corrosion cracking (SCC) test was performed using a jig 1 as shown in FIG. 2, by imposing a stress corresponding to the 0.2% proof stress of the alloy tested on an SCC test specimen 2 with the jig. While the test specimen 2 was maintained in such a stressed condition, the same synthetic ash as used in the above-described high-temperature corrosion test was applied to the front surface of the test specimen and exposed to the same gas stream as used above at 750° F. (400° C.) for 20 hours. In this test, a test temperature of 750° F. was employed, since the present inventors had found that austenitic alloys generally exhibited the highest susceptibility to SCC at a temperature around 750° F. The occurrence of SCC was determined by measuring the maximum penetration around the semicircular notched portion of the SCC test specimen shown in FIGS. 1(A) and 1(B) under an optical microscope.

The test results are shown in Table 2 with respect to weight loss, maximum penetration of intergranular corrosion (max. penetration), and occurrence or non-occurrence of SCC for each test alloy.

As can be seen from Table 2, each inventive alloy was superior with respect to all the properties tested to the comparative and conventional alloys, particularly with respect to resistance to SCC and resistance to intergranular corrosion due to the addition of Mo in a controlled amount. It is also noted that those inventive alloys containing 0.75% or more of Si had significantly improved resistance to uniform corrosion.

In contrast, each of the comparative and conventional alloys was unsatisfactory with respect to at least one property tested. Particularly it is noted that SCC occurred in Alloys Nos. 54, 55, 57, 59, and 60 which were comparative alloys containing Mo in an excessive amount. On the other hand, Alloys Nos. 31 to 53, 61, and 62 which were Mo-free comparative alloys showed deep penetration caused by intergranular corrosion attack. Alloy No. 56 could not be tested since the billet cracked during forging.

Of the conventional alloys tested, TP 316L (Alloy No. 65) and TP 310 (Alloy No. 66) showed greatly increased weight loss primarily due to the low Ni content, indicating degraded resistance to uniform corrosion in the tested corrosive environment, although their susceptibility to SCC was low. The other conventional alloys suffered SCC since the Mo content was either zero or exceeded the maximum content defined herein. TP 304 (Alloy No. 64) also suffered a severe uniform corrosion since its Ni content was very low.

EXAMPLE 2

This example illustrates inventive alloys each having a relatively high Mn content of more than 2.5% and not more than 7.5% and an Mo content satisfying the above inequality (2).

Two types of test specimens for the high-temperature corrosion test and SCC test, respectively, of the inventive alloys and comparative alloys having the compositions shown in Table 3 were prepared and tested in the same manner as described in Example 1 except that the ingot cast from each alloy was heated to a temperature in the range of 2000°-2300° F. (1100°-1250° C.) and that the sectional micrography to determine the maximum penetration of intergranular corrosion was performed under a 100X or 500X microscope. The test results are shown in Table 4. Alloy No. 80 could not be tested since the billet cracked during forging.

As can be seen from Table 4, each inventive alloy was superior with respect to all the properties tested to comparative alloys and no SCC occurred in any of the inventive 1B alloys. Thus, the susceptibility to SCC could be satisfactorily decreased by controlling the Mo content so as to satisfy the foregoing inequality (2) according to the present invention.

In contrast, each comparative alloy was unsatisfactory with respect to at least one property. Particularly it is noted that SCC occurred in Alloys Nos. 70 to 72 which were comparative alloys containing Mo in an excessive amount, demonstrating that the addition of an excessive amount of Mo adversely affects the resistance to SCC. On the other hand, each of Alloys Nos. 73 to 76 which were Mo-free comparative alloys showed deep penetration caused by intergranular corrosion attack. Therefore, it is critical to add Mo in an amount defined herein in order to attain improved corrosion resistance, particularly with respect to intergranular corrosion and SCC.

Alloy No. 79 which was a comparative alloy containing an excessive amount of C suffered severe intergranular corrosion, which was attributable to a reaction of chromium carbide precipitated at grain boundaries with a fused chloride in the ash applied to the test specimen. Intergranular corrosion was suppressed by controlling the C content to 0.05% or less as found in Alloys Nos. 7 and 21. Alloy No. 78 which was a comparative alloy containing an excessive amount of Cr suffered a greatly increased weight loss caused by uniform corrosion and had degraded corrosion resistance, although the susceptibility to SCC thereof was good.

EXAMPLE 3

This example illustrates inventive alloys each having a relatively low Si content of not more than 0.3%.

Two types of test specimens for the high-temperature corrosion test and SCC test, respectively, of the inventive and comparative alloys having the compositions shown in Table 5 were prepared and tested in the same manner as described in Example 1 except that the solution treatment of the cold-rolled plate was performed by heating at a temperature of 2000° F. (1100° C.) followed by water cooling and that the sectional micrography to determine the maximum penetration of intergranular corrosion was performed under a 100X or 500X microscope.

In this example, the high-temperature corrosion test was performed under the following two conditions.

(1) Corrosion test simulating a typical corrosive environment encountered in a refuse-fired heat-recovery boiler:

This corrosion test was performed in the same manner as the high-temperature corrosion test described in Example 1.

(2) Corrosion test simulating a typical corrosive environment encountered in a black-liquor combustion boiler:

This corrosion test was performed by applying a synthetic ash having a composition, by mole %, of 20% NaCl-22.5% $Na_2SO_4$-22.5% $K_2SO_4$-20% $Na_2CO_3$-15% $Fe_2O_3$ to opposite surfaces of each test specimen at an amount of 30 mg/cm$^2$ and heating the applied test specimen for 20 hours at a temperature of 1100° F. (600° C.) in a gas stream having a composition of 0.25% $SO_2$-1% $O_2$-15% $CO_2$-balance $N_2$.

The test results obtained under the above test conditions (1) and (2) simulating an environment in a refuse-fired heat-recovery boiler and an environment in a black-liquor combustion boiler, respectively, are shown in Table 6.

Alloys Nos. 99 to 103 shown in Table 5 were conventional alloys corresponding to NO 8825 alloy defined in ASTM B163, TP 304, TP 316L, TP 310, and NO 8320 alloy defined in ASTM B622, respectively. Test specimens of these conventional alloys were cut out from commercially-available boiler tubes in the same manner as described in Example 1.

As can be seen from Table 6, each inventive alloy showed good resistance to uniform corrosion under both the high-temperature corrosion test conditions (1) and (2). In particular, it was significantly improved in resistance to intergranular corrosion attack due to the low Si content of at most 0.3%. More specifically, the maximum penetration of intergranular corrosion was suppressed to 5 μm or less under the test conditions (1) and to 2.5 μm or less under the test conditions (2) in each inventive alloy. The addition of at least one Group A element enabled the alloy to have further improved resistance to intergranular corrosion attack whereby intergranular corrosion was suppressed to such a degree that it could not be detected even under a 500X microscope. Each inventive alloy also showed a decreased susceptibility to SCC.

Compared to the inventive alloys, all the conventional alloys showed much inferior results with respect to resistance to uniform corrosion and intergranular corrosion under both the test conditions (1) and (2). As in Example 1, NO 8825, TP 304, and NO 8320 alloys suffered SCC.

EXAMPLE 4

This example illustrates the effect of grain refinement in inventive alloys on resistance to intergranular corrosion attack.

Test specimens for the high-temperature corrosion test and SCC test of the inventive alloys having the compositions shown in Table 7 were prepared and tested in the same manner as described in Example 3 except for conditions for solution treatment of the cold-rolled plate.

For Alloys Nos. 1 to 9, the solution treatment was performed by heating for 30 minutes at a temperature of 1750° F. (950° C.), 1790° F. (975° C.), or 2200° F. (1200° C.) followed by water cooling in order to provide each alloy with different grain sizes. In Table 7, test specimens of these alloys which had been solution-treated at temperatures 2200° F., 1790° F., and 1750° F. were marked (1), (2), and (3), respectively. All the other inventive alloys were subjected to solution-treatment by heating at 1790° F. for 30 minutes followed by water cooling. The grain size after the heat treatment is also indicated in Table 7.

The high-temperature corrosion test was performed under the two types of corrosive conditions described (1) and (2) in Example 3 which simulated an environment in a refuse-fired heat-recovery boiler and an environment in a black-liquor combustion boiler, respectively.

The test results are shown in Table 8. As can be seen from Table 8, each inventive alloy showed good resistance to uniform corrosion under both the high-temperature corrosion test conditions (1) and (2). In particular, it was significantly improved in resistance to intergranular corrosion attack when it had a grain size equal to ASTM grain size No. 7 or smaller (marked (2) or (3), i.e., when it was solution-treated at a relatively low temperature of 1790° F. or 1750° F. for Alloys Nos. 1 to 9). More specifically, the maximum penetration of intergranular corrosion was suppressed to 5 μm or less under the test conditions (1) and to 2.5 μm or less under the test conditions (2) in each inventive alloy having such a fine grain size. The inventive alloys also showed a decreased susceptibility to SCC.

In this example, those inventive alloys which contained at least one Group A element with an Mn content of not more than 2.5% Mn were tested, It is expected that other inventive alloys encompassed by the present invention will also exhibit significantly improved resistance to intergranular corrosion attack by grain refinement as illustrated in this example, It will be appreciated by those skilled in the art that numerous variations and modifications may be made to the invention as described above with respect to specific embodiments without departing from the spirit or scope of the invention as broadly described.

TABLE 1 (1)

| | ALLOY COMPOSITION (EXAMPLE 1) Chemical Composition (wt %) (bal.: Fe) | | | | | | | | | | |
|---|---|---|---|---|---|---|---|---|---|---|---|
| Alloy No. | C | Si | Mn | Cr | Ni | Mo | N | Group A | Group B | REM | 5.8-Ni/10 |
| Inventive Alloy | | | | | | | | | | | |
| 1 | 0.02 | 0.43 | 1.22 | 22.37 | 54.80 | 0.20 | | | | | 0.32 |
| 2 | 0.02 | 0.49 | 1.02 | 20.63 | 36.11 | 1.86 | | | | | 2.189 |
| 3 | 0.02 | 0.49 | 1.09 | 21.22 | 41.27 | 1.23 | | | | | 1.673 |
| 4 | 0.02 | 0.77 | 0.51 | 22.13 | 26.12 | 2.40 | | | | | 3.188 |
| 5 | 0.02 | 2.20 | 2.43 | 29.70 | 40.61 | 0.51 | | | | | 1.739 |
| 6 | 0.02 | 2.21 | 0.51 | 29.85 | 49.93 | 0.58 | | | | | 0.807 |
| 7 | 0.02 | 1.83 | 0.52 | 21.71 | 25.43 | 1.09 | | Ti: 0.40 | | | 3.257 |
| 8 | 0.04 | 0.80 | 0.50 | 20.52 | 39.26 | 0.95 | | V: 0.21 | | | 1.874 |
| 9 | 0.02 | 1.88 | 2.25 | 28.46 | 41.11 | 0.99 | | Ti: 0.12 | | | 1.689 |
| 10 | 0.02 | 2.92 | 0.51 | 21.48 | 49.44 | 0.53 | | Nb: 1.66<br>Ti: 1.07 | | | 0.856 |
| 11 | 0.03 | 1.72 | 0.51 | 29.31 | 49.46 | 0.51 | | Nb: 0.41<br>Ti: 0.26 | | | 0.854 |
| 12 | 0.02 | 2.22 | 0.50 | 21.03 | 26.11 | 1.53 | | | Cu: 4.67 | | 3.189 |
| 13 | 0.02 | 1.20 | 0.50 | 21.76 | 40.71 | 1.23 | | | W: 0.16 | | 1.729 |
| 14 | 0.02 | 1.63 | 2.40 | 29.26 | 40.63 | 1.00 | | | Co: 4.92 | | 1.737 |
| 15 | 0.02 | 1.88 | 0.51 | 20.08 | 49.15 | 0.55 | | | Cu: 2.08<br>Co: 0.27<br>W: 1.04 | | 0.885 |
| 16 | 0.02 | 1.72 | 0.50 | 29.80 | 49.42 | 0.60 | | | Cu: 2.15<br>Co: 2.02 | | 0.858 |
| 17 | 0.02 | 1.81 | 0.51 | 20.05 | 26.12 | 2.02 | | Nb: 0.40<br>Ti: 0.21 | Co: 0.16 | | 3.188 |
| 18 | 0.02 | 0.83 | 0.50 | 22.21 | 39.71 | 1.11 | | Ti: 0.41 | Cu: 2.21 | | 1.829 |
| 19 | 0.02 | 1.77 | 2.40 | 29.81 | 39.76 | 1.20 | | Ti: 0.41 | Cu: 1.25<br>Co: 2.35 | | 1.824 |
| 20 | 0.02 | 0.81 | 0.50 | 22.03 | 49.71 | 0.52 | | Zr: 0.25 | W: 4.83 | | 0.829 |
| 21 | 0.02 | 1.89 | 1.53 | 29.63 | 49.76 | 0.53 | | Nb: 0.55 | Co: 4.88 | | 0.824 |
| 22 | 0.02 | 2.20 | 2.23 | 28.90 | 40.22 | 1.01 | 0.13 | Ti: 0.39 | | | 1.778 |
| 23 | 0.02 | 2.49 | 2.26 | 29.33 | 37.05 | 1.12 | 0.28 | Ti: 0.44 | Cu: 2.50 | | 2.095 |

The impurity content was S ≦ 0.010% and P ≦ 0.030% in each alloy.

TABLE 1 (2)

| | ALLOY COMPOSITION (EXAMPLE 1) Chemical Composition (wt %) (bal.: Fe) | | | | | | | | | | |
|---|---|---|---|---|---|---|---|---|---|---|---|
| Alloy No. | C | Si | Mn | Cr | Ni | Mo | N | Group A | Group B | REM | 5.8-Ni/10 |
| Inventive Alloy | | | | | | | | | | | |
| 24 | 0.02 | 1.89 | 1.43 | 29.75 | 48.70 | 0.77 | 0.26 | Ti: 0.29 | Co: 2.21 | | 0.930 |
| 25 | 0.02 | 2.25 | 1.49 | 28.89 | 49.40 | 0.65 | | Ti: 0.39 | Co: 2.11 | La: 0.07 | 0.860 |
| 26 | 0.02 | 1.82 | 1.51 | 20.15 | 38.92 | 0.98 | | Ti: 0.22 | Cu: 2.20 | La + Ce:0.05 | 1.908 |
| 27 | 0.02 | 1.70 | 1.06 | 20.11 | 40.66 | 0.92 | 0.19 | Nb: 0.89<br>Zr: 1.24 | | | 1.734 |
| 28 | 0.02 | 1.74 | 0.95 | 20.05 | 37.43 | 1.06 | 0.16 | | Cu: 2.33 | | 2.057 |
| 29 | 0.02 | 1.72 | 1.02 | 20.26 | 38.38 | 0.97 | 0.26 | Nb: 0.93<br>V: 0.99 | | Y: 0.06 | 1.962 |
| 30 | 0.02 | 1.60 | 0.98 | 21.33 | 41.11 | 1.21 | 0.26 | Ti: 0.55<br>Zr: 1.00 | | La: 0.01<br>Ce: 0.03 | 1.689 |
| Comparative Alloy | | | | | | | | | | | |

TABLE 1 (2)-continued

| Alloy No. | C | Si | Mn | Cr | Ni | Mo | N | Group A | Group B | REM | 5.8-Ni/10 |
|---|---|---|---|---|---|---|---|---|---|---|---|
| | ALLOY COMPOSITION (EXAMPLE 1) Chemical Composition (wt %) (bal.: Fe) | | | | | | | | | | |
| 31 | 0.02 | 0.51 | 1.09 | 21.37 | 36.69 | 0 | | | | | |
| 32 | 0.02 | 0.50 | 1.02 | 20.88 | 40.88 | 0 | | | | | |
| 33 | 0.02 | 0.50 | 1.39 | 20.33 | 54.06 | 0 | | | | | |
| 34 | 0.02 | 0.40 | 0.44 | 24.77 | 42.66 | 0 | | | | | |
| 35 | 0.02 | 0.22 | 1.07 | 21.30 | 42.16 | 0 | | Ti: 0.40 | | | |
| 36 | 0.02 | 0.20 | 1.12 | 21.82 | 41.09 | 0 | | | | | |
| 37 | 0.02 | 0.20 | 1.11 | 21.99 | 41.54 | 0 | | Nb: 0.63<br>Ti: 0.21 | | | |
| 38 | 0.02 | 0.25 | 0.30 | 20.33 | 35.75 | 0 | | Nb: 0.88<br>Ti: 0.41<br>Zr: 0.81 | | | |
| 39 | 0.02 | 0.65 | 0.99 | 29.41 | 41.74 | 0 | | | | | |
| 40 | 0.02 | 0.85 | 1.09 | 20.38 | 32.81 | 0 | | | | | |
| 41 | 0.02 | 1.70 | 1.09 | 21.38 | 36.40 | 0 | | | | | |
| 42 | 0.02 | 1.66 | 1.05 | 20.10 | 43.73 | 0 | | Ti: 0.40<br>Zr: 1.22 | | | |
| 43 | 0.02 | 1.78 | 0.99 | 20.07 | 42.59 | 0 | | Nb: 0.97<br>Ti: 0.39<br>V: 1.09 | | | |
| 44 | 0.01 | 1.66 | 0.89 | 20.11 | 38.59 | 0 | | | Cu: 1.85<br>Co: 1.22<br>W: 0.98 | | |

The impurity content was S ≦ 0.010% and P ≦ 0.030% in each alloy.
Underlined content is outside the range defined herein.

TABLE 1 (3)

| Alloy No. | C | Si | Mn | Cr | Ni | Mo | N | Group A | Group B | REM | 5.8-Ni/10 |
|---|---|---|---|---|---|---|---|---|---|---|---|
| | ALLOY COMPOSITION (EXAMPLE 1) Chemical Composition (wt %) (bal.: Fe) | | | | | | | | | | |
| Comparative Alloy | | | | | | | | | | | |
| 45 | 0.02 | 1.62 | 0.96 | 20.05 | 37.42 | 0 | 0.25 | | | | |
| 46 | 0.02 | 1.73 | 1.00 | 20.05 | 44.27 | 0 | | | | La: 0.04 | |
| 47 | 0.02 | 1.70 | 0.97 | 20.07 | 38.25 | 0 | | Ti: 0.42 | Cu: 1.99 | | |
| 48 | 0.02 | 1.69 | 1.21 | 20.22 | 42.17 | 0 | | Zr: 0.99 | | Y: 0.03 | |
| 49 | 0.02 | 1.42 | 1.10 | 20.17 | 36.42 | 0 | | | W: 2.34 | Y: 0.04 | |
| 50 | 0.02 | 1.60 | 1.01 | 20.25 | 40.73 | 0 | 0.20 | | | La: 0.06 | |
| 51 | 0.02 | 1.63 | 0.97 | 20.22 | 38.26 | 0 | 0.19 | Nb: 0.92 | Cu: 2.45 | | |
| 52 | 0.02 | 3.87 | 0.19 | 20.11 | 41.32 | 0 | | | | | |
| 53 | 0.02 | 3.54 | 0.10 | 22.20 | 41.88 | 0 | | Nb: 0.32 | | | |
| 54 | 0.02 | 0.50 | 1.02 | 20.27 | 36.99 | 3.05 | | | | | 2.101 |
| 55 | 0.02 | 0.33 | 0.42 | 20.49 | 53.99 | 0.62 | | | | | 0.401 |
| 56 | 0.02 | 4.73 | 0.11 | 19.89 | 43.30 | 0 | | | | | |
| 57 | 0.02 | 1.49 | 1.51 | 21.26 | 41.47 | 2.68 | | | | | 1.653 |
| 58 | 0.02 | 1.88 | 0.99 | 13.26 | 25.98 | 0.92 | | Nb: 0.79 | Cu: 2.10 | | 3.202 |
| 59 | 0.02 | 1.67 | 1.01 | 34.55 | 54.50 | 0.99 | | Nb: 0.92 | Cu: 1.77 | | 0.350 |
| 60 | 0.01 | 1.73 | 1.01 | 19.99 | 57.62 | 0.86 | | Nb: 0.80 | Cu: 1.83 | | 0.038 |
| 61 | 0.02 | 1.70 | 0.98 | 32.36 | 54.89 | 0 | | Nb: 0.88 | Cu: 1.53 | | |
| 62 | 0.02 | 1.69 | 1.26 | 20.24 | 58.61 | 0 | | Nb: 0.90 | Cu: 1.66 | | |
| Conventional | | | | | | | | | | | |
| 63 | 0.02 | 0.37 | 0.65 | 21.99 | 41.03 | 2.54 | | Ti: 0.96 | Cu: 1.79 | (Al: 0.10) | 1.697 |
| 64 | 0.05 | 0.50 | 1.48 | 18.23 | 8.88 | 0 | | | | | |
| 65 | 0.02 | 0.49 | 1.52 | 16.90 | 13.29 | 2.43 | | | | | 4.471 |
| 66 | 0.03 | 0.51 | 1.00 | 25.11 | 19.88 | 0 | | | | | |
| 67 | 0.02 | 0.39 | 0.33 | 21.19 | 25.32 | 4.39 | | Ti: 0.15 | | | 3.268 |

The impurity content was S ≦ 0.010% and P ≦ 0.030% in each alloy except for conventional alloys.
Underlined content is outside the range defined herein.

TABLE 2 (1)

| Alloy No. | Weight loss (mg/cm²) | Max. penetration (μm) | SCC |
|---|---|---|---|
| | TEST RESULTS (EXAMPLE 1) | | |
| Inventive Alloy | | | |
| 1 | 32.5 | 70 | No |
| 2 | 43.5 | 20 | " |
| 3 | 42.9 | 20 | " |
| 4 | 26.2 | 20 | " |
| 5 | 19.3 | 20 | " |
| 6 | 18.0 | 20 | " |
| 7 | 27.4 | 10 | " |
| 8 | 30.4 | 10 | " |
| 9 | 19.9 | 10 | " |
| 10 | 14.0 | 10 | " |
| 11 | 22.2 | 10 | " |

TABLE 2 (1)-continued

| Alloy No. | Weight loss (mg/cm²) | Max. penetration (μm) | SCC |
|---|---|---|---|
| | TEST RESULTS (EXAMPLE 1) | | |
| 12 | 22.9 | 20 | " |
| 13 | 28.0 | 20 | " |
| 14 | 28.3 | 20 | " |
| 15 | 18.1 | 20 | " |
| 16 | 23.3 | 20 | " |
| 17 | 28.2 | 10 | " |
| 18 | 29.2 | 10 | " |
| 19 | 25.0 | 10 | " |
| 20 | 27.9 | 10 | " |
| 21 | 20.3 | 10 | " |
| 22 | 22.0 | 10 | " |
| 23 | 17.6 | 10 | " |

TABLE 2 (1)-continued

| Alloy No. | TEST RESULTS (EXAMPLE 1) Weight loss (mg/cm$^2$) | Max. penetration (μm) | SCC |
|---|---|---|---|
| 24 | 18.8 | 10 | " |
| 25 | 16.2 | 10 | " |
| 26 | 22.9 | 10 | " |
| 27 | 23.9 | 10 | " |
| 28 | 24.8 | 20 | " |
| 29 | 25.6 | 10 | " |
| 30 | 24.2 | 10 | " |
| Comparative Alloy | | | |
| 31 | 43.0 | 150 | No |
| 32 | 39.7 | 150 | " |
| 33 | 33.2 | 150 | " |
| 34 | 37.4 | 150 | " |
| 35 | 37.9 | 100 | " |
| 36 | 38.3 | 150 | " |
| 37 | 38.8 | 100 | " |
| 38 | 44.8 | 100 | " |
| 39 | 43.9 | 150 | " |
| 40 | 26.3 | 150 | " |
| 41 | 23.7 | 150 | " |
| 42 | 23.5 | 100 | " |
| 43 | 22.9 | 100 | " |
| 44 | 24.7 | 150 | " |
| 45 | 24.9 | 150 | " |

TABLE 2 (1)-continued

| Alloy No. | TEST RESULTS (EXAMPLE 1) Weight loss (mg/cm$^2$) | Max. penetration (μm) | SCC |
|---|---|---|---|
| 46 | 22.4 | 150 | " |
| 47 | 24.3 | 100 | " |
| 48 | 23.5 | 100 | " |
| 49 | 24.8 | 150 | " |
| 50 | 24.0 | 150 | " |
| 51 | 24.4 | 100 | " |
| 52 | 16.8 | 150 | " |
| 53 | 17.3 | 100 | " |
| 54 | 43.4 | 20 | Yes |
| 55 | 53.2 | 20 | " |
| 56 | — | — | — |
| 57 | 22.1 | 20 | Yes |
| 58 | 62.7 | 20 | No |
| 59 | 69.5 | 20 | Yes |
| 60 | 20.1 | 20 | " |
| 61 | 75.3 | 150 | No |
| 62 | 19.8 | 150 | " |
| Conventional | | | |
| 63 | 40.7 | 10 | Yes |
| 64 | 96.3 | 350 | " |
| 65 | 93.9 | 80 | No |
| 66 | 77.0 | 200 | " |
| 67 | 53.4 | 10 | Yes |

TABLE 3 (1)

| Alloy No. | ALLOY COMPOSITION (EXAMPLE 2) Chemical Composition (wt %) (bal.: Fe) C | Si | Mn | Cr | Ni | Mo | N | Group A | Group B | REM | 7.5-Ni/10 |
|---|---|---|---|---|---|---|---|---|---|---|---|
| Inventive Alloy | | | | | | | | | | | |
| 1 | 0.02 | 1.51 | 2.88 | 20.55 | 25.44 | 0.99 | | | | | 4.956 |
| 2 | 0.02 | 1.77 | 5.03 | 20.32 | 25.39 | 1.21 | | | | | 4.961 |
| 3 | 0.02 | 1.28 | 7.21 | 20.88 | 26.12 | 0.95 | | | | | 4.888 |
| 4 | 0.03 | 0.21 | 2.64 | 20.49 | 38.64 | 0.88 | | | | | 3.636 |
| 5 | 0.02 | 0.23 | 4.99 | 20.81 | 40.23 | 1.11 | | | | | 3.477 |
| 6 | 0.02 | 0.34 | 6.84 | 20.23 | 40.85 | 1.08 | | | | | 3.415 |
| 7 | 0.04 | 0.35 | 2.66 | 21.07 | 53.99 | 0.99 | | | | | 2.101 |
| 8 | 0.02 | 0.39 | 4.87 | 20.53 | 54.21 | 1.05 | | | | | 2.079 |
| 9 | 0.02 | 0.25 | 7.29 | 20.27 | 54.88 | 1.21 | | | | | 2.012 |
| 10 | 0.02 | 0.21 | 2.77 | 28.25 | 26.02 | 1.03 | | | | | 4.898 |
| 11 | 0.02 | 0.25 | 5.66 | 27.72 | 26.33 | 1.19 | | | | | 4.867 |
| 12 | 0.03 | 0.26 | 7.09 | 28.62 | 25.49 | 0.93 | | | | | 4.951 |
| 13 | 0.02 | 0.31 | 2.53 | 28.21 | 42.13 | 0.96 | | | | | 3.287 |
| 14 | 0.02 | 0.22 | 4.68 | 28.33 | 42.22 | 0.99 | | | | | 3.278 |
| 15 | 0.02 | 0.23 | 7.33 | 28.11 | 39.59 | 0.99 | | | | | 3.541 |
| 16 | 0.03 | 0.22 | 2.66 | 28.05 | 54.18 | 1.12 | | | | | 2.082 |
| 17 | 0.02 | 0.27 | 5.64 | 28.11 | 52.25 | 0.94 | | | | | 2.275 |
| 18 | 0.02 | 0.21 | 7.44 | 28.23 | 54.16 | 1.11 | | | | | 2.084 |
| 19 | 0.02 | 0.23 | 2.68 | 33.84 | 41.23 | 0.96 | | | | | 3.377 |
| 20 | 0.02 | 0.22 | 4.98 | 34.51 | 40.52 | 1.02 | | | | | 3.448 |
| 21 | 0.04 | 0.22 | 7.19 | 34.58 | 41.59 | 0.89 | | | | | 3.341 |
| 22 | 0.02 | 0.25 | 2.55 | 34.11 | 53.22 | 0.95 | | | | | 2.178 |
| 23 | 0.02 | 0.31 | 5.61 | 34.88 | 54.89 | 0.95 | | | | | 2.011 |
| 24 | 0.05 | 0.31 | 7.45 | 34.88 | 51.28 | 0.97 | | | | | 2.372 |
| 25 | 0.02 | 0.22 | 4.85 | 27.55 | 26.31 | 0.66 | | | | | 4.869 |
| 26 | 0.02 | 0.21 | 4.44 | 28.17 | 25.81 | 4.26 | | | | | 4.919 |
| 27 | 0.02 | 0.26 | 4.92 | 27.95 | 40.23 | 0.68 | | | | | 3.477 |

The impurity content was S ≦ 0.010% and P ≦ 0.030% in each alloy.

TABLE 3 (2)

| Alloy No. | ALLOY COMPOSITION (EXAMPLE 2) Chemical Composition (wt %) (bal.: Fe) C | Si | Mn | Cr | Ni | Mo | N | Group A | Group B | REM | 7.5-Ni/10 |
|---|---|---|---|---|---|---|---|---|---|---|---|
| Inventive Alloy | | | | | | | | | | | |
| 28 | 0.02 | 0.31 | 4.35 | 28.43 | 40.86 | 3.21 | | | | | 3.414 |
| 29 | 0.02 | 0.25 | 4.33 | 32.55 | 54.29 | 0.88 | | | | | 2.071 |
| 30 | 0.02 | 0.22 | 4.86 | 33.08 | 54.88 | 1.99 | | | | | 2.012 |
| 31 | 0.03 | 0.25 | 3.35 | 27.55 | 41.02 | 1.56 | | Nb: 0.4 | | | 3.398 |
| 32 | 0.03 | 0.25 | 4.21 | 29.86 | 38.91 | 1.44 | | Nb: 0.11 | | | 3.609 |
| 33 | 0.02 | 0.26 | 4.88 | 29.22 | 41.29 | 1.64 | | Nb: 2.88 | | | 3.371 |
| 34 | 0.03 | 0.23 | 3.2 | 27.91 | 39.84 | 1.53 | | Ti: 0.26 | | | 3.516 |
| 35 | 0.02 | 0.22 | 3.16 | 27.96 | 39.59 | 1.55 | | Zr: 0.94 | | | 3.541 |
| 36 | 0.02 | 0.22 | 3.28 | 28.12 | 39.66 | 1.53 | | V: 2.11 | | | 3.534 |
| 37 | 0.02 | 0.21 | 3.5 | 28.21 | 40.29 | 1.39 | | Nb: 0.66 | | | 3.471 |

TABLE 3 (2)-continued

| Alloy No. | C | Si | Mn | Cr | Ni | Mo | N | Group A | Group B | REM | 7.5-Ni/10 |
|---|---|---|---|---|---|---|---|---|---|---|---|
| | ALLOY COMPOSITION (EXAMPLE 2) Chemical Composition (wt %) (bal.: Fe) | | | | | | | | | | |
| 38 | 0.04 | 0.21 | 3.61 | 27.79 | 40.38 | 1.66 | | Ti: 0.35<br>Nb: 0.42<br>Zr: 0.84 | | | 3.462 |
| 39 | 0.04 | 0.25 | 3.28 | 27.68 | 40.02 | 1.22 | | Nb: 0.34<br>V: 1.96 | | | 3.498 |
| 40 | 0.02 | 0.31 | 4.56 | 27.25 | 38.64 | 1.26 | | | Cu: 3.22 | | 3.636 |
| 41 | 0.02 | 0.31 | 4.52 | 27.63 | 39.51 | 1.53 | | | Co: 4.65 | | 3.549 |
| 42 | 0.03 | 0.35 | 4.79 | 27.54 | 41.25 | 1.55 | | | W: 2.99 | | 3.375 |
| 43 | 0.02 | 0.52 | 5.31 | 27.66 | 42.84 | 1.44 | | | Cu: 0.13 | | 3.216 |
| 44 | 0.02 | 0.31 | 4.19 | 27.6 | 41.05 | 1.48 | | | Cu: 1.98<br>Co: 2.11 | | 3.395 |
| 45 | 0.02 | 0.27 | 4.66 | 27.99 | 40.29 | 1.36 | | | Co: 2.21<br>W: 1.66 | | 3.471 |
| 46 | 0.02 | 0.24 | 4.22 | 26.58 | 40.57 | 1.42 | | | Cu: 0.99<br>Co: 2.10<br>W: 0.97 | | 3.443 |
| 47 | 0.03 | 0.24 | 4.63 | 28.13 | 40.66 | 1.67 | | | Cu: 2.58<br>W: 1.56 | | 3.434 |
| 48 | 0.02 | 0.26 | 5.02 | 27.64 | 40.58 | 1.72 | | | | Y: 0.02 | 3.442 |
| 49 | 0.02 | 0.23 | 5.09 | 27.77 | 42.31 | 1.64 | 0.15 | | | Ce: 0.06 | 3.269 |

The impurity content was S ≦ 0.010% and P ≦ 0.030% in each alloy.

TABLE 3 (3)

| Alloy No. | | C | Si | Mn | Cr | Ni | Mo | N | Group A | Group B | REM | 7.5-Ni/10 |
|---|---|---|---|---|---|---|---|---|---|---|---|---|
| | | ALLOY COMPOSITION (EXAMPLE 2) Chemical Composition (wt %) (bal.: Fe) | | | | | | | | | | |
| Inventive | 50 | 0.02 | 0.22 | 5.21 | 27.69 | 41.16 | 1.65 | | | | La: 0.09 | 3.384 |
| Alloy | 51 | 0.02 | 0.22 | 5.11 | 28.02 | 42.08 | 1.82 | | | | Y: 0.01<br>La: 0.06<br>Ce: 0.02 | 3.292 |
| | 52 | 0.03 | 0.25 | 3.64 | 27.94 | 42.06 | 1.68 | | Nb: 0.44 | Cu: 2.10 | | 3.294 |
| | 53 | 0.02 | 0.21 | 3.72 | 28.26 | 40.21 | 1.46 | | Nb: 0.84 | Co: 4.67 | | 3.479 |
| | 54 | 0.02 | 0.22 | 3.12 | 28.24 | 38.32 | 1.55 | | Nb: 0.39 | W: 3.08 | | 3.668 |
| | 55 | 0.02 | 0.26 | 3.75 | 28.03 | 39.99 | 1.28 | | Nb: 0.64 | Cu: 2.09<br>W: 2.11 | | 3.501 |
| | 56 | 0.02 | 0.26 | 3.67 | 28.64 | 38.56 | 1.64 | | Nb: 0.32 | Cu: 1.00<br>Co: 2.21<br>W: 1.68 | | 3.644 |
| | 57 | 0.02 | 0.22 | 4.67 | 27.12 | 40.31 | 1.52 | 0.14 | Nb: 0.38 | | Y: 0.02 | 3.469 |
| | 58 | 0.02 | 0.21 | 4.81 | 27.68 | 40.39 | 1.46 | | Nb: 0.84<br>Ti: 0.43 | | Y: 0.06 | 3.461 |
| | 59 | 0.02 | 0.22 | 3.23 | 28.81 | 40.38 | 1.06 | | | Cu: 2.21 | Y: 0.03 | 3.462 |
| | 60 | 0.02 | 0.21 | 3.32 | 28.88 | 39.99 | 1.09 | 0.16 | | W: 4.02 | Ce: 0.06 | 3.501 |
| | 61 | 0.02 | 0.26 | 3.19 | 28.19 | 39.42 | 1.61 | | | Cu: 2.08<br>W: 2.21 | Y: 0.01<br>La: 0.05 | 3.558 |
| | 62 | 0.02 | 0.24 | 3.49 | 28.46 | 41.61 | 1.54 | | Nb: 0.64 | W: 3.67 | Y: 0.05 | 3.339 |
| | 63 | 0.03 | 0.22 | 3.44 | 26.88 | 38.11 | 0.99 | | Nb: 0.35 | | (Al: 0.44) | 3.689 |
| | 64 | 0.02 | 0.25 | 4.32 | 27.53 | 41.63 | 1.44 | 0.11 | | | | 3.337 |
| | 65 | 0.02 | 0.27 | 4.44 | 27.06 | 40.21 | 1.55 | 0.12 | Nb: 0.44 | | | 3.479 |
| | 66 | 0.02 | 0.21 | 4.87 | 27.3 | 40.08 | 1.49 | 0.15 | | Cu: 2.06 | | 3.492 |
| | 67 | 0.02 | 0.21 | 4.65 | 27.09 | 40.64 | 1.44 | 0.13 | Nb: 0.32 | W: 3.21 | | 3.436 |
| | 68 | 0.02 | 0.23 | 4.46 | 21.01 | 25.66 | 1.56 | 0.21 | Nb: 0.29 | Co: 4.44 | | 4.934 |
| | 69 | 0.02 | 0.22 | 4.55 | 27.46 | 38.86 | 1.46 | 0.12 | Nb: 0.33 | W: 3.68 | Y: 0.06 | 3.614 |

The impurity content was S ≦ 0.010% and P ≦ 0.030% in each alloy.

TABLE 3 (4)

| Alloy No. | | C | Si | Mn | Cr | Ni | Mo | N | Group A | Group B | REM | 7.5-Ni/10 |
|---|---|---|---|---|---|---|---|---|---|---|---|---|
| | | ALLOY COMPOSITION (EXAMPLE 2) Chemical Composition (wt %) (bal.: Fe) | | | | | | | | | | |
| Comparative | 70 | 0.02 | 0.22 | 4.28 | 20.64 | 26.04 | 6.01 | | | | | 4.896 |
| Alloy | 71 | 0.02 | 0.31 | 5.02 | 27.66 | 40.83 | 5.11 | | | | | 3.417 |
| | 72 | 0.02 | 0.21 | 4.88 | 31.29 | 52.21 | 5.32 | | | | | 2.279 |
| | 73 | 0.02 | 0.26 | 4.56 | 28.11 | 38.46 | 0 | | | | | |
| | 74 | 0.02 | 0.21 | 4.44 | 27.99 | 40.25 | 0 | | Nb: 0.33 | | | |
| | 75 | 0.02 | 0.26 | 4.65 | 21.03 | 25.69 | 0 | | | | | |
| | 76 | 0.02 | 0.22 | 5.32 | 34.27 | 54.22 | 0 | | | | | |
| | 77 | 0.02 | 0.53 | 7.28 | 10.24 | 38.99 | 1.44 | | | | | 3.601 |
| | 78 | 0.02 | 0.55 | 4.88 | 40.34 | 50.24 | 1.54 | | | | | 2.476 |
| | 79 | 0.11 | 0.21 | 4.98 | 28.32 | 41.28 | 1.44 | | Nb: 0.28 | | | 3.372 |

TABLE 3 (4)-continued

| ALLOY COMPOSITION (EXAMPLE 2) | | | | | | | | | | | |
|---|---|---|---|---|---|---|---|---|---|---|---|
| | Chemical Composition (wt %) (bal.: Fe) | | | | | | | | | | |
| Alloy No. | C | Si | Mn | Cr | Ni | Mo | N | Group A | Group B | REM | 7.5-Ni/10 |
| 80 | 0.02 | 0.22 | 10.22 | 27.46 | 39.66 | 1.5 | | | | | 3.534 |

The impurity content was S ≦ 0.010% and P ≦ 0.030% in each alloy.
Underlined content is outside the range defined herein.

TABLE 4

| TEST RESULTS (EXAMPLE 2) | | | | |
|---|---|---|---|---|
| Alloy No. | | Weight loss (Mg/cm²) | Max. penetration (μm) | SCC |
| Inventive Alloy | 1 | 30.4 | 20 | No |
| | 2 | 18.2 | 20 | " |
| | 3 | 13.6 | 20 | " |
| | 4 | 20.7 | 20 | " |
| | 5 | 12.3 | 20 | " |
| | 6 | 10.1 | 20 | " |
| | 7 | 17.9 | 20 | " |
| | 8 | 13.2 | 20 | " |
| | 9 | 10.0 | 20 | " |
| | 10 | 28.9 | 20 | " |
| | 11 | 14.0 | 20 | " |
| | 12 | 12.2 | 20 | " |
| | 13 | 29.3 | 20 | " |
| | 14 | 13.8 | 20 | " |
| | 15 | 9.8 | 20 | " |
| | 16 | 18.8 | 20 | " |
| | 17 | 10.9 | 20 | " |
| | 18 | 8.9 | 20 | " |
| | 19 | 18.3 | 20 | " |
| | 20 | 11.9 | 20 | " |
| | 21 | 9.5 | 20 | " |
| | 22 | 16.2 | 20 | " |
| | 23 | 9.7 | 20 | " |
| | 24 | 7.3 | 20 | " |
| | 25 | 19.3 | 20 | " |
| | 26 | 19.0 | 20 | " |
| | 27 | 14.5 | 20 | " |
| | 28 | 13.8 | 20 | " |
| | 29 | 12.4 | 20 | " |
| | 30 | 8.6 | 20 | " |
| | 31 | 17.6 | 10 | " |
| | 32 | 14.7 | 10 | " |
| | 33 | 12.9 | 10 | " |
| | 34 | 17.6 | 10 | " |
| | 35 | 17.4 | 10 | " |
| | 36 | 17.3 | 10 | " |
| | 37 | 16.0 | 10 | " |
| | 38 | 15.9 | 10 | " |
| | 39 | 16.6 | 10 | " |
| | 40 | 13.7 | 20 | " |

TABLE 4-continued

| TEST RESULTS (EXAMPLE 2) | | | | |
|---|---|---|---|---|
| Alloy No. | | Weight loss (Mg/cm²) | Max. penetration (μm) | SCC |
| | 41 | 13.2 | 20 | " |
| | 42 | 12.8 | 20 | " |
| | 43 | 11.6 | 20 | " |
| | 44 | 14.3 | 20 | " |
| | 45 | 13.0 | 20 | " |
| | 46 | 14.2 | 20 | " |
| | 47 | 13.1 | 20 | " |
| | 48 | 12.5 | 20 | " |
| | 49 | 12.3 | 20 | " |
| | 50 | 11.6 | 20 | " |
| | 51 | 12.4 | 20 | " |
| | 52 | 16.3 | 10 | " |
| | 53 | 15.9 | 10 | " |
| | 54 | 17.8 | 10 | " |
| | 55 | 15.0 | 10 | " |
| | 56 | 15.0 | 10 | " |
| | 57 | 12.9 | 10 | " |
| | 58 | 12.7 | 10 | " |
| | 59 | 17.0 | 20 | " |
| | 60 | 16.4 | 20 | " |
| | 61 | 16.8 | 20 | " |
| | 62 | 16.0 | 10 | " |
| | 63 | 16.5 | 10 | " |
| | 64 | 14.3 | 20 | " |
| | 65 | 13.9 | 10 | " |
| | 66 | 15.1 | 20 | " |
| | 67 | 12.9 | 10 | " |
| | 68 | 13.8 | 10 | " |
| | 69 | 13.5 | 10 | " |
| Comparative Alloy | 70 | 26.8 | 20 | Yes |
| | 71 | 12.3 | 20 | " |
| | 72 | 12.0 | 20 | " |
| | 73 | 25.7 | 120 | No |
| | 74 | 26.3 | 100 | " |
| | 75 | 56.2 | 150 | " |
| | 76 | 32.6 | 100 | " |
| | 77 | 63.2 | 20 | " |
| | 78 | 47.6 | 20 | " |
| | 79 | 48.3 | 200 | " |
| | 80 | — | — | — |

TABLE 5 (1)

| ALLOY COMPOSITION (EXAMPLE 3) | | | | | | | | | | | | |
|---|---|---|---|---|---|---|---|---|---|---|---|---|
| Alloy | Chemical Composition (wt %) (bal.: Fe) | | | | | | | | | | | 5.8-Ni/10 or |
| No. | C | Si | Mn | P | Cr | Ni | Mo | Group A | Group B | REM | Others | 7.5-Ni/10 |
| 1* | 0.02 | 0.21 | 0.50 | 0.031 | 25.77 | 26.31 | 0.97 | | | | | 3.169 |
| 2 | 0.02 | 0.20 | 0.52 | 0.014 | 25.36 | 26.22 | 0.98 | | | | | 3.178 |
| 3 | 0.03 | 0.22 | 0.49 | 0.010 | 25.44 | 25.13 | 1.22 | | | | | 3.287 |
| 4 | 0.02 | 0.25 | 0.50 | 0.012 | 25.21 | 25.81 | 1.03 | | | | | 3.219 |
| 5 | 0.02 | 0.10 | 0.51 | 0.012 | 25.11 | 25.64 | 1.00 | | | | | 3.236 |
| 6* | 0.02 | 0.21 | 0.52 | 0.035 | 29.48 | 40.23 | 1.10 | | | | | 1.777 |
| 7 | 0.02 | 0.22 | 0.53 | 0.014 | 30.12 | 40.05 | 0.89 | | | | | 1.795 |
| 8 | 0.02 | 0.21 | 0.50 | 0.011 | 29.58 | 40.29 | 0.94 | | | | | 1.771 |
| 9 | 0.03 | 0.24 | 0.49 | 0.013 | 29.86 | 40.29 | 0.98 | | | | | 1.771 |
| 10 | 0.02 | 0.10 | 0.48 | 0.012 | 29.68 | 38.94 | 0.99 | | | | | 1.906 |
| 11* | 0.02 | 0.20 | 0.49 | 0.033 | 34.55 | 54.21 | 0.30 | | | | | 0.379 |
| 12 | 0.02 | 0.21 | 0.50 | 0.014 | 34.69 | 54.09 | 0.31 | | | | | 0.391 |
| 13 | 0.02 | 0.21 | 0.51 | 0.011 | 34.66 | 54.14 | 0.30 | | | | | 0.386 |
| 14 | 0.03 | 0.22 | 0.50 | 0.013 | 34.66 | 54.88 | 0.30 | | | | | 0.312 |
| 15 | 0.02 | 0.11 | 0.51 | 0.014 | 34.88 | 54.81 | 0.30 | | | | | 0.319 |
| 16 | 0.02 | 0.20 | 3.51 | 0.011 | 26.48 | 26.66 | 1.32 | | | | | 4.834 |
| 17 | 0.02 | 0.20 | 7.44 | 0.012 | 25.46 | 26.11 | 1.03 | | | | | 4.889 |
| 18 | 0.02 | 0.21 | 2.99 | 0.014 | 29.41 | 41.26 | 1.21 | | | | | 3.374 |

TABLE 5 (1)-continued

ALLOY COMPOSITION (EXAMPLE 3)

| Alloy No. | Chemical Composition (wt %) (bal.: Fe) C | Si | Mn | P | Cr | Ni | Mo | Group A | Group B | REM | Others | 5.8-Ni/10 or 7.5-Ni/10 |
|---|---|---|---|---|---|---|---|---|---|---|---|---|
| 19 | 0.02 | 0.20 | 7.35 | 0.010 | 28.99 | 40.58 | 0.83 | | | | | 3.442 |
| 20 | 0.02 | 0.15 | 3.02 | 0.013 | 34.41 | 53.29 | 0.30 | | | | | 2.171 |
| 21 | 0.02 | 0.15 | 7.13 | 0.014 | 34.51 | 54.19 | 0.31 | | | | | 2.081 |
| 22 | 0.02 | 0.15 | 0.49 | 0.014 | 25.26 | 26.13 | 1.55 | Ti: 0.35 | | | | 3.187 |
| 23 | 0.02 | 0.20 | 0.49 | 0.013 | 25.98 | 26.55 | 0.99 | Nb: 0.33 | | | | 3.145 |
| 24 | 0.02 | 0.21 | 0.50 | 0.013 | 25.64 | 25.6 | 1.03 | Zr: 0.88 | | | | 3.24 |
| 25 | 0.02 | 0.18 | 0.50 | 0.013 | 25.69 | 26.33 | 1.05 | V: 2.13 | | | | 3.167 |

*Comparative alloy since the underlined content is outside the range defined herein.
The content of S was 0.010% or less in each alloy.

TABLE 5 (2)

ALLOY COMPOSITION (EXAMPLE 3)

| Alloy No. | Chemical Composition (wt %) (bal.: Fe) C | Si | Mn | P | Cr | Ni | Mo | Group A | Group B | REM | Others | 5.8-Ni/10 or 7.5-Ni/10 |
|---|---|---|---|---|---|---|---|---|---|---|---|---|
| 26 | 0.02 | 0.19 | 0.59 | 0.012 | 25.13 | 25.94 | 1.22 | Ti: 0.15<br>Nb: 0.26 | | | | 3.206 |
| 27 | 0.03 | 0.20 | 0.51 | 0.013 | 25.64 | 26.11 | 1.03 | Ti: 0.21<br>Nb: 0.26<br>Zr: 0.99<br>V: 1.10 | | | | 3.189 |
| 28 | 0.02 | 0.20 | 0.51 | 0.014 | 30.22 | 40.21 | 1.00 | Ti: 0.33 | | | | 1.779 |
| 29 | 0.02 | 0.18 | 0.50 | 0.014 | 29.56 | 40.35 | 0.95 | Nb: 0.30 | | | | 1.765 |
| 30 | 0.03 | 0.18 | 0.50 | 0.013 | 29.88 | 41.23 | 1.03 | Zr: 0.89 | | | | 1.677 |
| 31 | 0.02 | 0.15 | 0.49 | 0.013 | 29.85 | 40.94 | 0.89 | V: 1.56 | | | | 1.706 |
| 32 | 0.02 | 0.21 | 0.49 | 0.014 | 31.02 | 40.66 | 0.99 | Ti: 0.11<br>Nb: 0.32 | | | | 1.734 |
| 33 | 0.02 | 0.20 | 0.49 | 0.012 | 30.54 | 40.29 | 0.98 | Ti: 0.11<br>Nb: 0.35<br>Zr: 0.99<br>V: 1.55 | | | | 1.771 |
| 34 | 0.03 | 0.19 | 0.50 | 0.012 | 34.66 | 53.29 | 0.30 | Ti: 0.22 | | | | 0.471 |
| 35 | 0.02 | 0.16 | 0.50 | 0.014 | 34.66 | 54.12 | 0.31 | Nb: 0.33 | | | | 0.388 |
| 36 | 0.02 | 0.20 | 0.49 | 0.013 | 34.29 | 54.00 | 0.31 | Zr: 0.88 | | | | 0.400 |
| 37 | 0.02 | 0.20 | 0.51 | 0.010 | 34.20 | 53.69 | 0.30 | V: 3.35 | | | | 0.431 |
| 38 | 0.02 | 0.20 | 0.50 | 0.012 | 34.88 | 53.21 | 0.32 | Ti: 0.11<br>Nb: 0.35 | | | | 0.479 |
| 39 | 0.02 | 0.18 | 0.50 | 0.015 | 34.26 | 54.88 | 0.30 | Ti: 0.11<br>Nb: 0.32<br>Zr: 0.88<br>V: 1.09 | | | | 0.312 |
| 40 | 0.02 | 0.15 | 0.49 | 0.015 | 25.63 | 26.66 | 0.99 | | Cu: 3.15 | | | 3.134 |
| 41 | 0.03 | 0.15 | 0.50 | 0.014 | 25.11 | 26.31 | 0.99 | | W: 3.26 | | | 3.169 |
| 42 | 0.02 | 0.15 | 0.59 | 0.014 | 26.11 | 25.31 | 0.88 | | Co: 4.12 | | | 3.269 |
| 43 | 0.02 | 0.19 | 0.50 | 0.012 | 25.44 | 25.87 | 0.94 | | Cu: 2.00<br>W: 2.55<br>Co: 0.33 | | | 3.213 |

The content of S was 0.010% or less in each alloy.

TABLE 5 (3)

ALLOY COMPOSITION (EXAMPLE 3)

| Alloy No. | Chemical Composition (wt %) (bal.: Fe) C | Si | Mn | P | Cr | Ni | Mo | Group A | Group B | REM | Others | 5.8-Ni/10 or 7.5-Ni/10 |
|---|---|---|---|---|---|---|---|---|---|---|---|---|
| 44 | 0.02 | 0.20 | 0.51 | 0.013 | 30.54 | 42.19 | 0.89 | | Cu: 3.10 | | | 1.581 |
| 45 | 0.02 | 0.20 | 0.51 | 0.011 | 29.44 | 38.67 | 0.99 | | W: 4.55 | | | 1.933 |
| 46 | 0.03 | 0.20 | 0.50 | 0.011 | 29.40 | 39.45 | 0.89 | | Co: 4.87 | | | 1.855 |
| 47 | 0.02 | 0.20 | 0.49 | 0.013 | 30.28 | 41.06 | 1.22 | | Cu: 2.21<br>W: 1.06<br>Co: 1.11 | | | 1.694 |
| 48 | 0.02 | 0.18 | 0.49 | 0.012 | 34.51 | 53.99 | 0.31 | | Cu: 3.26 | | | 0.401 |
| 49 | 0.02 | 0.17 | 0.50 | 0.012 | 34.29 | 54.68 | 0.33 | | W: 3.06 1 | | | 0.332 |
| 50 | 0.02 | 0.15 | 0.50 | 0.009 | 34.19 | 54.88 | 0.30 | | Co: 4.55 | | | 0.312 |
| 51 | 0.03 | 0.16 | 0.51 | 0.009 | 34.88 | 53.69 | 0.33 | | Cu: 2.03<br>W: 2.11<br>Co: 0.54 | | | 0.431 |
| 52 | 0.02 | 0.16 | 0.51 | 0.012 | 25.13 | 25.66 | 0.99 | Nb: 0.33 | Cu: 3.54 | | | 3.234 |
| 53 | 0.02 | 0.20 | 0.51 | 0.012 | 25.36 | 25.12 | 0.98 | Nb: 0.38 | W: 4.88 | | | 3.288 |
| 54 | 0.02 | 0.20 | 0.50 | 0.013 | 25.22 | 25.26 | 0.99 | Nb: 0.31 | Co: 4.57 | | | 3.274 |
| 55 | 0.02 | 0.20 | 0.50 | 0.014 | 25.10 | 25.26 | 0.89 | Ti: 0.15<br>Nb: 0.33 | Cu: 3.10<br>W: 1.66 | | | 3.274 |
| 56 | 0.02 | 0.20 | 0.50 | 0.012 | 25.33 | 25.49 | 0.92 | Ti: 0.21 | Cu: 1.53 | | | 3.251 |

TABLE 5 (3)-continued

ALLOY COMPOSITION (EXAMPLE 3)

| Alloy No. | Chemical Composition (wt %) (bal.: Fe) C | Si | Mn | P | Cr | Ni | Mo | Group A | Group B | REM | Others | 5.8-Ni/10 or 7.5-Ni/10 |
|---|---|---|---|---|---|---|---|---|---|---|---|---|
| | | | | | | | | Nb: 0.32<br>Zr: 1.22<br>V: 1.09 | W: 3.21<br>Co: 0.12 | | | |
| 57 | 0.02 | 0.18 | 0.54 | 0.012 | 29.89 | 38.94 | 1.03 | Nb: 0.32 | Cu: 3.18 | | | 1.906 |
| 58 | 0.02 | 0.18 | 0.51 | 0.014 | 29.99 | 38.16 | 1.16 | Nb: 0.33 | W: 4.55 | | | 1.984 |
| 59 | 0.03 | 0.20 | 0.51 | 0.014 | 29.67 | 39.46 | 1.02 | Nb: 0.30 | Co: 4.80 | | | 1.854 |
| 60 | 0.02 | 0.20 | 0.50 | 0.012 | 29.86 | 39.69 | 1.05 | Ti: 0.09<br>Nb: 0.29 | Cu: 2.22<br>W: 2.51 | | | 1.831 |
| 61 | 0.02 | 0.17 | 0.59 | 0.013 | 29.42 | 39.66 | 1.02 | Ti: 0.11<br>Nb: 0.32<br>Zr: 0.68<br>V: 0.89 | Cu: 1.56<br>W: 2.09<br>Co: 1.11 | | | 1.834 |
| 62 | 0.02 | 0.15 | 0.51 | 0.013 | 34.46 | 54.23 | 0.31 | Nb: 0.22 | Cu: 3.26 | | | 0.377 |
| 63 | 0.03 | 0.15 | 0.50 | 0.011 | 34.69 | 53.79 | 0.30 | Nb: 0.22 | W: 4.42 | | | 0.421 |

The content of S was 0.010% or less in each alloy.

TABLE 5 (4)

ALLOY COMPOSITION (EXAMPLE 3)

| Alloy No. | Chemical Composition (wt %) (bal.: Fe) C | Si | Mn | P | Cr | Ni | Mo | Group A | Group B | REM | Others | 5.8-Ni/10 or 7.5-Ni/10 |
|---|---|---|---|---|---|---|---|---|---|---|---|---|
| 64 | 0.02 | 0.20 | 0.49 | 0.012 | 34.86 | 54.06 | 0.30 | Nb: 0.26 | Co: 4.23 | | | 0.394 |
| 65 | 0.02 | 0.20 | 0.51 | 0.012 | 34.56 | 54.3 | 0.31 | Ti: 0.07<br>Nb: 0.24 | Cu: 2.21<br>W: 2.04 | | | 0.37 |
| 66 | 0.02 | 0.20 | 0.51 | 0.013 | 34.66 | 54.09 | 0.30 | Ti: 0.08<br>Nb: 0.21<br>Zr: 0.66<br>V: 1.21 | Cu: 2.03<br>W: 2.11<br>Co: 0.22 | | | 0.391 |
| 67 | 0.03 | 0.20 | 0.50 | 0.014 | 29.84 | 40.22 | 0.98 | | | Y: 0.06 | | 1.778 |
| 68 | 0.02 | 0.15 | 0.51 | 0.011 | 28.88 | 40.26 | 0.99 | | | Ce: 0.04 | | 1.774 |
| 69 | 0.02 | 0.19 | 0.49 | 0.010 | 28.84 | 40.64 | 1.22 | | | La: 0.06 | | 1.736 |
| 70 | 0.02 | 0.18 | 0.49 | 0.011 | 29.40 | 39.06 | 0.98 | | | Y: 0.01<br>Ce: 0.02<br>La: 0.02 | | 1.894 |
| 71 | 0.02 | 0.20 | 0.49 | 0.013 | 28.40 | 39.84 | 1.00 | Nb: 0.31 | | Y: 0.03 | | 1.816 |
| 72 | 0.02 | 0.18 | 0.49 | 0.012 | 29.64 | 39.07 | 1.23 | Nb: 0.32 | | Ce: 0.04 | | 1.893 |
| 73 | 0.02 | 0.18 | 0.50 | 0.012 | 29.55 | 39.46 | 0.99 | Nb: 0.33 | | La: 0.06 | | 1.854 |
| 74 | 0.02 | 0.17 | 0.51 | 0.013 | 29.19 | 38.99 | 1.00 | Ti: 0.08<br>Nb: 0.29<br>Zr: 0.99<br>V: 1.49 | | Y: 0.01<br>Ce: 0.01<br>La: 0.01 | | 1.901 |
| 75 | 0.02 | 0.20 | 0.51 | 0.013 | 28.59 | 39.06 | 0.98 | | Cu: 2.06<br>W: 2.26 | Y: 0.06 | | 1.894 |
| 76 | 0.02 | 0.20 | 0.50 | 0.012 | 29.87 | 39.50 | 0.89 | | Cu: 2.02<br>W: 2.09<br>Co: 0.51 | Y: 0.01<br>Ce: 0.02<br>La: 0.02 | | 1.850 |
| 77 | 0.02 | 0.20 | 0.51 | 0.014 | 29.46 | 39.64 | 0.89 | Nb: 0.30 | Cu: 2.03<br>W: 2.48<br>Co: 0.26 | Y: 0.05 | | 1.836 |
| 78 | 0.02 | 0.19 | 0.55 | 0.014 | 29.88 | 39.01 | 0.88 | Ti: 0.09<br>Nb: 0.28<br>Zr: 0.96<br>V: 1.08 | Cu: 2.04<br>W: 2.12<br>Co: 0.46 | Y: 0.01<br>Ce: 0.02<br>La: 0.02 | | 1.899 |
| 79 | 0.02 | 0.02 | 0.49 | 0.014 | 28.86 | 39.48 | 0.99 | | | | Al: 0.21 | 1.852 |
| 80 | 0.02 | 0.02 | 0.49 | 0.013 | 29.66 | 38.63 | 1.21 | Nb: 0.32 | | | Al: 0.16 | 1.937 |

The content of S was 0.010% or less in each alloy.

TABLE 5(5)

ALLOY COMPOSITION (EXAMPLE 3)

| Alloy No. | Chemical Composition (wt %) (bal.: Fe) C | Si | Mn | P | Cr | Ni | Mo | Group A | Group B | REM | Others | 5.8-Ni/10 or 7.5-Ni/10 |
|---|---|---|---|---|---|---|---|---|---|---|---|---|
| 81 | 0.02 | 0.02 | 0.50 | 0.013 | 29.84 | 39.64 | 1.10 | | W: 4.55 | | Al: 0.44 | 1.836 |
| 82 | 0.03 | 0.20 | 0.50 | 0.014 | 29.88 | 41.20 | 1.06 | Nb: 0.33 | W: 3.21 | | Al: 0.48 | 1.680 |
| 83 | 0.02 | 0.21 | 0.49 | 0.011 | 28.99 | 40.21 | 1.03 | | | Y: 0.05 | Al: 0.26 | 1.779 |
| 84 | 0.02 | 0.21 | 0.51 | 0.009 | 29.58 | 40.15 | 1.00 | Nb: 0.29 | | Ce: 0.04 | Al: 0.41 | 1.785 |
| 85 | 0.03 | 0.20 | 0.50 | 0.013 | 29.65 | 38.19 | 0.94 | | W: 4.59 | Y: 0.05 | Al: 0.33 | 1.981 |
| 86 | 0.02 | 0.23 | 0.50 | 0.012 | 29.88 | 39.40 | 0.99 | Nb: 0.25 | W: 2.04 | Ce: 0.06 | Al: 0.21 | 1.860 |
| 87 | 0.02 | 0.22 | 0.49 | 0.015 | 28.64 | 39.54 | 0.99 | | | | N: 0.13 | 1.846 |
| 88 | 0.02 | 0.20 | 0.49 | 0.013 | 29.48 | 39.44 | 0.89 | Nb: 0.32 | | | N: 0.14 | 1.856 |
| 89 | 0.03 | 0.20 | 0.51 | 0.013 | 29.68 | 41.00 | 0.99 | | W: 4.55 | | N: 0.13 | 1.700 |
| 90 | 0.02 | 0.21 | 0.51 | 0.015 | 29.88 | 40.55 | 1.02 | Nb: 0.28 | W: 4.22 | | N: 0.11 | 1.745 |
| 91 | 0.02 | 0.18 | 0.50 | 0.012 | 29.76 | 41.06 | 1.00 | | | Y: 0.06 | N: 0.13 | 1.694 |

TABLE 5(5)-continued

| Alloy No. | ALLOY COMPOSITION (EXAMPLE 3) Chemical Composition (wt %) (bal.: Fe) C | Si | Mn | P | Cr | Ni | Mo | Group A | Group B | REM | Others | 5.8-Ni/10 or 7.5-Ni/10 |
|---|---|---|---|---|---|---|---|---|---|---|---|---|
| 92 | 0.02 | 0.18 | 0.49 | 0.015 | 29.81 | 38.66 | 1.03 | Nb: 0.22 | | Ce: 0.06 | N: 0.12 | 1.934 |
| 93 | 0.02 | 0.16 | 0.49 | 0.012 | 29.79 | 39.11 | 1.06 | | W: 4.44 | Y: 0.04 | N: 0.15 | 1.889 |
| 94 | 0.02 | 0.20 | 0.50 | 0.013 | 29.99 | 39.46 | 0.99 | Nb: 0.33 | W: 4.48 | Y: 0.04 | N: 0.12 | 1.854 |
| 95 | 0.03 | 0.20 | 0.49 | 0.010 | 28.53 | 38.66 | 0.99 | | | | Al: 0.12<br>N: 0.11 | 1.934 |
| 96 | 0.02 | 0.16 | 0.52 | 0.013 | 29.76 | 40.53 | 0.99 | Nb: 0.33 | | | Al: 0.11<br>N: 0.12 | 1.747 |
| 97 | 0.02 | 0.12 | 0.51 | 0.009 | 29.88 | 40.79 | 1.02 | Nb: 0.29 | W: 4.44 | | Al: 0.11<br>N: 0.10 | 1.721 |
| 98 | 0.02 | 0.20 | 0.05 | 0.013 | 29.48 | 40.28 | 1.03 | Nb: 0.28 | W: 4.22 | Y: 0.05 | Al: 0.22<br>N: 0.10 | 1.772 |
| 99** | 0.02 | 0.37 | 0.65 | 0.026 | 21.99 | 41.03 | 2.54 | Ti: 0.96 | Cu: 1.79 | | Al: 0.10 | 1.697 |
| 100** | 0.05 | 0.50 | 1.48 | 0.038 | 18.23 | 8.88 | 0 | | | | | |
| 101** | 0.02 | 0.49 | 1.52 | 0.032 | 16.90 | 13.29 | 2.43 | | | | | 4.471 |
| 102** | 0.03 | 0.51 | 1.00 | 0.029 | 25.11 | 19.88 | 0 | | | | | |
| 103** | 0.02 | 0.39 | 0.33 | 0.025 | 21.19 | 25.32 | 4.39 | Ti: 0.15 | | | | 3.268 |

**Conventional alloy and the underlined content was outside the range defined herein.
The content of S was 0.010% or less in each alloy.

TABLE 6(1)

| Alloy No. | TEST RESULTS (EXAMPLE 3) Corrosive Conditons (1) Weight loss (mg/cm²) | Max. penetration (μm) | SCC | Corrosive Conditions (2) Weight loss (mg/cm²) | Max. penetration (μm) |
|---|---|---|---|---|---|
| 1* | 36.2 | 20 | No | 24.3 | 15 |
| 2 | 35.1 | 5 | " | 25.0 | <2.5 |
| 3 | 34.2 | 5 | " | 24.9 | <2.5 |
| 4 | 36.7 | 5 | " | 25.8 | <2.5 |
| 5 | 33.5 | 5 | " | 25.9 | <2.5 |
| 6* | 26.3 | 30 | " | 19.2 | 20 |
| 7 | 25.1 | 5 | " | 20.3 | <2.5 |
| 8 | 25.4 | 5 | " | 21.4 | <2.5 |
| 9 | 24.0 | 5 | " | 20.5 | <2.5 |
| 10 | 25.7 | 5 | " | 20.7 | <2.5 |
| 11* | 19.9 | 20 | " | 14.2 | 15 |
| 12 | 20.3 | 5 | " | 14.8 | <2.5 |
| 13 | 20.1 | 5 | " | 14.0 | <2.5 |
| 14 | 20.3 | 5 | " | 15.4 | <2.5 |
| 15 | 19.5 | 5 | " | 15.7 | <2.5 |
| 16 | 32.3 | 5 | " | 22.2 | <2.5 |
| 17 | 12.0 | 5 | " | 15.3 | <2.5 |
| 18 | 23.1 | 5 | " | 16.2 | <2.5 |
| 19 | 10.0 | 5 | " | 10.6 | <2.5 |
| 20 | 15.2 | 5 | " | 9.2 | <2.5 |
| 21 | 9.0 | 5 | " | 5.3 | <2.5 |
| 22 | 35.2 | <2.5 | " | 26.3 | <2.5 |
| 23 | 34.3 | <2.5 | " | 25.8 | <2.5 |
| 24 | 35.1 | <2.5 | " | 26.4 | <2.5 |
| 25 | 36.8 | <2.5 | " | 25.0 | <2.5 |
| 26 | 34.3 | <2.5 | " | 24.9 | <2.5 |
| 27 | 35.9 | <2.5 | " | 24.9 | <2.5 |
| 28 | 24.8 | <2.5 | " | 20.5 | <2.5 |
| 29 | 24.3 | <2.5 | " | 20.6 | <2.5 |
| 30 | 24.7 | <2.5 | " | 21.0 | <2.5 |
| 31 | 26.8 | <2.5 | " | 22.3 | <2.5 |
| 32 | 24.0 | <2.5 | " | 20.4 | <2.5 |
| 33 | 25.4 | <2.5 | " | 21.8 | <2.5 |
| 34 | 19.2 | <2.5 | " | 12.7 | <2.5 |

*Comparative alloy

TABLE 6(2)

| Alloy No. | TEST RESULTS (EXAMPLE 3) Corrosive Conditons (1) Weight loss (mg/cm²) | Max. penetration (μm) | SCC | Corrosive Conditions (2) Weight loss (mg/cm²) | Max. penetration (μm) |
|---|---|---|---|---|---|
| 35 | 19.3 | <2.5 | No | 12.8 | <2.5 |
| 36 | 19.5 | <2.5 | " | 11.8 | <2.5 |
| 37 | 21.5 | <2.5 | " | 11.5 | <2.5 |
| 38 | 19.4 | <2.5 | " | 12.6 | <2.5 |
| 39 | 20.6 | <2.5 | " | 15.3 | <2.5 |
| 40 | 36.3 | 5 | " | 25.3 | <2.5 |
| 41 | 34.1 | 5 | " | 26.7 | <2.5 |
| 42 | 34.2 | 5 | " | 25.1 | <2.5 |
| 43 | 34.0 | 5 | " | 24.1 | <2.5 |
| 44 | 25.8 | 5 | " | 19.1 | <2.5 |
| 45 | 24.8 | 5 | " | 18.9 | <2.5 |
| 46 | 24.4 | 5 | " | 19.5 | <2.5 |
| 47 | 24.2 | 5 | " | 19.9 | <2.5 |
| 48 | 19.9 | 5 | " | 12.6 | <2.5 |
| 49 | 19.5 | 5 | " | 12.4 | <2.5 |
| 50 | 19.4 | 5 | " | 12.0 | <2.5 |
| 51 | 19.4 | 5 | " | 11.8 | <2.5 |
| 52 | 34.9 | <2.5 | " | 26.0 | <2.5 |
| 53 | 34.7 | <2.5 | " | 24.1 | <2.5 |
| 54 | 34.8 | <2.5 | " | 25.8 | <2.5 |
| 55 | 35.0 | <2.5 | " | 25.3 | <2.5 |
| 56 | 35.8 | <2.5 | " | 27.5 | <2.5 |
| 57 | 25.1 | <2.5 | " | 20.7 | <2.5 |
| 58 | 24.5 | <2.5 | " | 20.4 | <2.5 |
| 59 | 24.6 | <2.5 | " | 20.5 | <2.5 |
| 60 | 25.0 | <2.5 | " | 20.5 | <2.5 |
| 61 | 24.3 | <2.5 | " | 21.5 | <2.5 |
| 62 | 19.4 | <2.5 | " | 11.9 | <2.5 |
| 63 | 18.7 | <2.5 | " | 11.8 | <2.5 |
| 64 | 19.3 | <2.5 | " | 12.0 | <2.5 |
| 65 | 19.3 | <2.5 | " | 11.4 | <2.5 |
| 66 | 21.2 | <2.5 | " | 13.5 | <2.5 |
| 67 | 26.2 | 5 | " | 20.3 | <2.5 |
| 68 | 26.3 | 5 | " | 21.0 | <2.5 |
| 69 | 26.2 | 5 | " | 21.2 | <2.5 |

TABLE 6(3)

| TEST RESULTS (EXAMPLE 3) | | | | | |
|---|---|---|---|---|---|
| | Corrosive Conditons (1) | | | Corrosive Conditions (2) | |
| Alloy No. | Weight loss (mg/cm²) | Max. penetration (μm) | SCC | Weight loss (mg/cm²) | Max. penetration (μm) |
| 70 | 26.0 | 5 | No | 20.4 | <2.5 |
| 71 | 25.1 | <2.5 | " | 20.5 | <2.5 |
| 72 | 24.5 | <2.5 | " | 20.5 | <2.5 |
| 73 | 24.8 | <2.5 | " | 20.0 | <2.5 |
| 74 | 24.0 | <2.5 | " | 21.8 | <2.5 |
| 75 | 24.3 | 5 | " | 21.0 | <2.5 |
| 76 | 24.3 | 5 | " | 20.7 | <2.5 |
| 77 | 24.0 | <2.5 | " | 20.1 | <2.5 |
| 78 | 25.6 | <2.5 | " | 22.4 | <2.5 |
| 79 | 25.6 | 5 | " | 20.6 | <2.5 |
| 80 | 24.8 | <2.5 | " | 20.1 | <2.5 |
| 81 | 24.1 | 5 | " | 20.3 | <2.5 |
| 82 | 24.0 | <2.5 | " | 21.4 | <2.5 |
| 83 | 25.3 | 5 | " | 21.0 | <2.5 |
| 84 | 25.1 | <2.5 | " | 21.3 | <2.5 |
| 85 | 24.1 | 5 | " | 20.5 | <2.5 |
| 86 | 24.0 | <2.5 | " | 21.4 | <2.5 |
| 87 | 25.0 | 5 | " | 20.6 | <2.5 |

TABLE 6(3)-continued

| TEST RESULTS (EXAMPLE 3) | | | | | |
|---|---|---|---|---|---|
| | Corrosive Conditons (1) | | | Corrosive Conditions (2) | |
| Alloy No. | Weight loss (mg/cm²) | Max. penetration (μm) | SCC | Weight loss (mg/cm²) | Max. penetration (μm) |
| 88 | 25.3 | <2.5 | " | 20.1 | <2.5 |
| 89 | 24.0 | 5 | " | 22.1 | <2.5 |
| 90 | 24.3 | <2.5 | " | 22.5 | <2.5 |
| 91 | 25.7 | 5 | " | 20.1 | <2.5 |
| 92 | 25.3 | <2.5 | " | 19.4 | <2.5 |
| 93 | 24.5 | 5 | " | 22.1 | <2.5 |
| 94 | 24.0 | <2.5 | " | 22.4 | <2.5 |
| 95 | 25.8 | 5 | " | 19.5 | <2.5 |
| 96 | 25.4 | <2.5 | " | 20.1 | <2.5 |
| 97 | 24.5 | <2.5 | " | 22.5 | <2.5 |
| 98 | 24.1 | <2.5 | " | 22.4 | <2.5 |
| 99** | 40.0 | 10 | Yes | 80.2 | 10 |
| 100** | 92.3 | 350 | " | 120.5 | 100 |
| 101** | 88.6 | 80 | No | 150.3 | 30 |
| 102** | 74.3 | 200 | " | 55.8 | 75 |
| 103** | 48.2 | 10 | yes | 67.5 | 10 |

**Conventional alloy

TABLE 7(1)

| ALLOY COMPOSITION EXAMPLE 4 | | | | | | | | | | | |
|---|---|---|---|---|---|---|---|---|---|---|---|
| | Chemical Composition (wt %) (bal.: Fe) | | | | | | | | | | |
| Alloy No. | C | Si | Mn | Cr | Ni | Mo | Group A | Group B | Others | 5.8-Ni/10 | ASTM Grain Size No. |
| 1-(1) | | | | | | | | | | | 4* |
| (2) | 0.02 | 1.93 | 0.99 | 25.22 | 26.43 | 0.99 | Nb: 0.26 | | | 3.157 | 7.5 |
| (3) | | | | | | | | | | | 10 |
| 2-(1) | | | | | | | | | | | 5* |
| (2) | 0.03 | 1.71 | 0.52 | 29.88 | 25.51 | 1.03 | Nb: 0.31 | | | 3.249 | 7.5 |
| (3) | | | | | | | | | | | 9 |
| 3-(1) | | | | | | | | | | | 4* |
| (2) | 0.04 | 0.24 | 2.4 | 34.55 | 25.09 | 1 | Nb: 0.30 | | | 3.291 | 7.5 |
| (3) | | | | | | | | | | | 10 |
| 4-(1) | | | | | | | | | | | 5* |
| (2) | 0.02 | 0.19 | 0.48 | 25.16 | 40.33 | 0.97 | Nb: 0.44 | | | 1.767 | 8 |
| (3) | | | | | | | | | | | 10 |
| 5-(1) | | | | | | | | | | | 5* |
| (2) | 0.02 | 0.15 | 0.49 | 29.99 | 39.08 | 0.88 | Nb: 0.41 | | | 1.892 | 8 |
| (3) | | | | | | | | | | | 10 |
| 6-(1) | | | | | | | | | | | 4* |
| (2) | 0.04 | 0.23 | 2.36 | 34.88 | 40.29 | 0.91 | Nb: 0.28 | | | 1.771 | 7.5 |
| (3) | | | | | | | | | | | 9.5 |
| 7-(1) | | | | | | | | | | | 5* |
| (2) | 0.02 | 0.31 | 0.53 | 25.24 | 54.66 | 0.31 | Nb: 0.23 | | | 0.334 | 7.5 |
| (3) | | | | | | | | | | | 9 |
| 8-(1) | | | | | | | | | | | 5* |
| (2) | 0.02 | 0.21 | 0.52 | 30.21 | 54.88 | 0.3 | Nb: 0.19 | | | 0.312 | 7.5 |
| (3) | | | | | | | | | | | 9 |
| 9-(1) | | | | | | | | | | | 5* |
| (2) | 0.02 | 0.23 | 0.48 | 34.88 | 53.97 | 0.31 | Nb: 0.23 | | | 0.403 | 7.5 |
| (3) | | | | | | | | | | | 10 |

*Grain size coarser than ASTM No. 7.
The content of S was 0.010% or less and the content of P was 0.030% or less in each alloy.

TABLE 7(2)

| ALLOY COMPOSITION (EXAMPLE 4) | | | | | | | | | | | |
|---|---|---|---|---|---|---|---|---|---|---|---|
| | Chemical Composition (wt %) (bal.: Fe) | | | | | | | | | | |
| Alloy No. | C | Si | Mn | Cr | Ni | Mo | Group A | Group B | Others | 5.8-Ni/10 | ASTM Grain Size No. |
| 10 | 0.02 | 0.21 | 0.49 | 28.64 | 40.67 | 0.99 | Ti: 0.26 | | | 1.733 | 8 |
| 11 | 0.02 | 0.2 | 0.51 | 29.66 | 41.58 | 1.02 | Zr: 0.46 | | | 1.642 | 8 |
| 12 | 0.04 | 0.21 | 0.50 | 29.4 | 40.19 | 0.99 | Ti: 0.08<br>Nb: 0.23 | | | 1.781 | 7.5 |
| 13 | 0.02 | 0.21 | 0.50 | 30.11 | 41.06 | 0.86 | Ti: 0.12<br>Zr: 0.88 | | | 1.694 | 7.5 |
| 14 | 0.02 | 0.2 | 0.51 | 28.46 | 40.88 | 1.11 | Nb: 0.34<br>Zr: 1.55 | | | 1.712 | 7.5 |
| 15 | 0.02 | 0.25 | 0.52 | 29.41 | 40.78 | 1.02 | Ti: 0.22<br>Nb: 0.89<br>Zr: 1.73 | | | 1.722 | 7.5 |
| 16 | 0.02 | 0.21 | 0.52 | 29.66 | 40.13 | 1 | Nb: 0.23 | | | 1.787 | 8 |
| 17 | 0.02 | 0.21 | 0.50 | 29.11 | 41.61 | 0.88 | Nb: 1.29 | | | 1.639 | 8 |
| 18 | 0.03 | 0.22 | 0.49 | 29.56 | 40.26 | 0.94 | Nb: 0.32 | Co: 3.80 | | 1.774 | 8 |
| 19 | 0.02 | 0.21 | 0.49 | 30.02 | 41.22 | 1.03 | Nb: 0.66 | Cu: 2.33 | | 1.678 | 7.5 |

TABLE 7(2)-continued

| Alloy No. | C | Si | Mn | Cr | Ni | Mo | Group A | Group B | Others | 5.8-Ni/10 | ASTM Grain Size No. |
|---|---|---|---|---|---|---|---|---|---|---|---|
| | ALLOY COMPOSITION (EXAMPLE 4) Chemical Composition (wt %) (bal.: Fe) | | | | | | | | | | |
| 20 | 0.02 | 0.2 | 0.51 | 30.26 | 41.28 | 1.12 | Nb: 0.18 | W: 2.16<br>Cu: 2.08<br>Co: 2.55 | | 1.672 | 8 |
| 21 | 0.02 | 0.19 | 0.50 | 29.64 | 40.66 | 0.98 | Nb: 0.14 | Cu: 2.11<br>W: 1.12<br>Co: 1.53 | | 1.734 | 8.5 |
| 22 | 0.02 | 0.19 | 0.50 | 29.46 | 42.06 | 0.99 | Nb: 0.32 | | N: 0.12 | 1.594 | 8 |
| 23 | 0.04 | 0.2 | 0.52 | 28.99 | 40.81 | 1.21 | Ti: 0.11<br>Nb: 0.34<br>Zr: 2.11 | | N: 0.15 | 1.719 | 8 |
| 24 | 0.02 | 0.17 | 0.50 | 29.43 | 39.47 | 1.03 | Nb: 0.25 | W: 4.22 | N: 0.11 | 1.853 | 7.5 |
| 25 | 0.02 | 0.2 | 0.49 | 28.43 | 38.99 | 1.05 | Nb: 0.33 | Cu: 2.03<br>W: 2.33<br>Co: 0.54 | N: 0.12 | 1.901 | 7.5 |
| 26 | 0.02 | 0.21 | 0.49 | 29.44 | 41.32 | 0.99 | Ti: 0.12<br>Nb: 0.56<br>Zr: 2.06 | Cu: 1.08<br>W: 2.88<br>Co: 0.88 | N: 0.11 | 1.668 | 8 |
| 27 | 0.02 | 0.2 | 0.51 | 29.13 | 38.59 | 1.14 | Nb: 0.26 | | Al: 0.44 | 1.941 | 7.5 |

The content of S was 0.010% or less and the content of P was 0.030% or less in each alloy.

TABLE 7 (3)

| Alloy No. | C | Si | Mn | Cr | Ni | Mo | Group A | Group B | Others | 5.8-Ni/10 | ASTM Grain Size No. |
|---|---|---|---|---|---|---|---|---|---|---|---|
| | ALLOY COMPOSITION (EXAMPLE 4) Chemical Composition (wt %) (bal.: Fe) | | | | | | | | | | |
| 28 | 0.02 | 0.22 | 0.52 | 29.56 | 39.67 | 1.23 | Ti: 0.08<br>Nb: 0.26<br>Zr: 1.84 | | Al: 0.13 | 1.833 | 7.5 |
| 29 | 0.02 | 0.25 | 0.54 | 29.18 | 39.59 | 1.03 | Nb: 0.22 | | Al: 0.22 | 1.841 | 8 |
| 30 | 0.02 | 0.2 | 0.51 | 29.94 | 38.91 | 1.06 | Nb: 0.31 | | Al: 0.45 | 1.909 | 8 |
| 31 | 0.03 | 0.2 | 0.50 | 30.19 | 41.28 | 1.06 | Ti: 0.12<br>Nb: 0.84<br>Zr: 1.86 | | Al: 0.33 | 1.672 | 9 |
| 32 | 0.02 | 0.19 | 0.51 | 30.21 | 40.67 | 0.99 | Ti: 0.08<br>Nb: 0.77<br>Zr: 1.53 | Cu: 2.08<br>W: 2.11<br>Co: 0.73 | Al: 0.12 | 1.733 | 8 |
| 33 | 0.04 | 0.18 | 0.49 | 29.85 | 40.22 | 0.99 | Ti: 0.30 | | Al: 0.11<br>N: 0.12 | 1.778 | 8.5 |
| 34 | 0.02 | 0.18 | 0.50 | 29.88 | 40.15 | 0.94 | Ti: 0.25 | W: 2.23 | Al: 0.35<br>N: 0.13 | 1.785 | 8 |
| 35 | 0.03 | 0.20 | 0.50 | 29.93 | 40.09 | 0.99 | Ti: 0.43<br>Nb: 0.73<br>Zr: 0.88 | W: 2.01<br>Cu: 1.86<br>Co: 0.25 | Al: 0.20<br>N: 0.11 | 1.791 | 8 |

The content of S was 0.010% or less and the content of P was 0.030% or less in each alloy.

TABLE 8 (1)

| Alloy No. | Corrosive Conditions (1) Weight loss (mg/cm²) | Max. penetration (μm) | SCC | Corrosive Conditions (2) Weight loss (mg/cm²) | Max. penetration (μm) |
|---|---|---|---|---|---|
| | TEST RESULTS (EXAMPLE 4) | | | | |
| 1-(1)* | 36.2 | 10 | No | 26.3 | 15 |
| (2) | 35.9 | 5 | " | 25.7 | <2.5 |
| (3) | 35.8 | 5 | " | 24.9 | <2.5 |
| 2-(1)* | 32.6 | 10 | No | 21.5 | 15 |
| (2) | 32.8 | 5 | " | 20.4 | <2.5 |
| (3) | 32 | 5 | " | 19.9 | <2.5 |
| 3-(1)* | 29.8 | 10 | No | 16.8 | 15 |
| (2) | 30.2 | 5 | " | 16 | <2.5 |
| (3) | 30.2 | 5 | " | 15.2 | <2.5 |
| 4-(1)* | 22.9 | 10 | No | 26.6 | 15 |
| (2) | 22.6 | 5 | " | 26.1 | <2.5 |
| (3) | 22.5 | 5 | " | 24.9 | <2.5 |
| 5-(1)* | 26.6 | 10 | No | 21.1 | 15 |
| (2) | 25.3 | 5 | " | 21.6 | <2.5 |
| (3) | 25.6 | 5 | " | 20 | <2.5 |
| 6-(1)* | 27.9 | 10 | No | 15.6 | 15 |
| (2) | 27.2 | 5 | " | 15.6 | <2.5 |
| (3) | 26.9 | 5 | " | 14.4 | <2.5 |
| 7-(1)* | 31.2 | 10 | No | 25.8 | 15 |
| (2) | 29.8 | 5 | " | 25.4 | <2.5 |
| (3) | 29.4 | 5 | " | 25 | <2.5 |

TABLE 8 (1)-continued

| Alloy No. | Corrosive Conditions (1) Weight loss (mg/cm²) | Max. penetration (μm) | SCC | Corrosive Conditions (2) Weight loss (mg/cm²) | Max. penetration (μm) |
|---|---|---|---|---|---|
| | TEST RESULTS (EXAMPLE 4) | | | | |
| 8-(1)* | 28 | 10 | No | 21.1 | 15 |
| (2) | 27.6 | 5 | " | 21.3 | <2.5 |
| (3) | 27.3 | 5 | " | 19.4 | <2.5 |
| 9-(1)* | 21.2 | 10 | No | 16.2 | 15 |
| (2) | 20.6 | 5 | " | 14 | <2.5 |
| (3) | 19.8 | 5 | " | 13.9 | <2.5 |
| 10 | 25.4 | 5 | No | 19.8 | <2.5 |
| 11 | 25.9 | 5 | " | 19.2 | <2.5 |
| 12 | 24.8 | 5 | " | 19.3 | <2.5 |
| 13 | 24.8 | 5 | " | 18.8 | <2.5 |
| 14 | 26.7 | 5 | " | 20.6 | <2.5 |
| 15 | 25.1 | 5 | " | 19.9 | <2.5 |

*Grain size coarser than ASTM No. 7.

TABLE 8 (2)

| TEST RESULTS (EXAMPLE 4) | | | | | |
|---|---|---|---|---|---|
| | Corrosive Conditions (1) | | | Corrosive Conditions (2) | |
| Alloy No. | Weight loss (mg/cm$^2$) | Max. penetration (μm) | SCC | Weight loss (mg/cm$^2$) | Max. penetration (μm) |
| 16 | 25 | 5 | No | 20.3 | <2.5 |
| 17 | 25.6 | 5 | " | 20.6 | <2.5 |
| 18 | 25.2 | 5 | " | 20.4 | <2.5 |
| 19 | 24.8 | 5 | " | 19.7 | <2.5 |
| 20 | 24.4 | 5 | " | 19.3 | <2.5 |
| 21 | 25.6 | 5 | " | 20.5 | <2.5 |
| 22 | 25.1 | 5 | " | 20.4 | <2.5 |
| 23 | 26.4 | 5 | " | 21.3 | <2.5 |
| 24 | 25.7 | 5 | " | 20.8 | <2.5 |
| 25 | 26.8 | 5 | " | 21.5 | <2.5 |
| 26 | 25.7 | 5 | " | 20.2 | <2.5 |
| 27 | 25.3 | 5 | " | 20 | <2.5 |
| 28 | 25.4 | 5 | " | 20 | <2.5 |
| 29 | 25.1 | 5 | " | 20.5 | <2.5 |
| 30 | 26.3 | 5 | " | 20.1 | <2.5 |
| 31 | 24.8 | 5 | " | 19.8 | <2.5 |
| 32 | 24.6 | 5 | " | 19.4 | <2.5 |
| 33 | 24.8 | 5 | " | 19.9 | <2.5 |
| 34 | 24.9 | 5 | " | 20.2 | <2.5 |
| 35 | 25.1 | 5 | " | 20.2 | <2.5 |

What is claimed is:

1. A corrosion-resistant heat transfer tube of a heat-recovery boiler which is made of an alloy consisting essentially, on a weight basis, of

| | | | |
|---|---|---|---|
| C: | not more than 0.05%, | Si: | not more than 4%, |
| Mn: | not more than 7.5%, | Ni: | $35 < Ni \leqq 55\%$, |
| Cr: | $25 < Cr \leqq 35\%$, | | |
| Mo: | an amount of at least 0.3% and satisfying the following inequality (1) when $Mn(\%) \leqq 2.5$ or inequality (2) when $2.5 < Mn(\%) \leqq 7.5$, | | |

$$Mo(\%) \leqq 5.8 - [Ni(\%)/10] \quad (1)$$

$$Mo(\%) \leqq 7.5 - [Ni(\%)/10] \quad (2)$$

one or more of Nb, Ti, Zr, and V:0–3% in total, one or more of Cu, Co, and W:0–5% in total,

| | |
|---|---|
| N: 0–0.3%, | Al: 0–0.5%, |

at least one rare earth metal: 0–0.1% in total, and a balance of Fe and incidental impurities in which the content of P is not more than 0.030% and that of S is not more than 0.010%.

2. The corrosion-resistant tube of claim 1, wherein one or more of Nb, Ti, Zr, and V are added in an amount of 0.1–3% in total.

3. The corrosion-resistant tube of claim 1, wherein one or more of Cu, Co, and W are added in an amount of 0.1–5% in total.

4. The corrosion-resistant tube of claim 1, wherein N is added in an amount of 0.1–0.3%.

5. The corrosion-resistant tube of claim 1, wherein at least one rare earth metal is added in an amount of 0.01–0.1% in total.

6. The corrosion-resistant tube of claim 1, wherein A1 is added in an amount of not more than 0.5%.

7. The corrosion-resistant tube of claim 1, wherein the alloy has a grain size equal to or less than ASTM grain size No. 7.

8. The corrosion-resistant tube of claim 1, wherein the Mo content satisfies inequality (1) with an Mn content of not more than 2.5%.

9. The corrosion-resistant tube of claim 1, wherein the Mo content satisfies inequality (2) with an Mn content of more than 2.5% and not more than 7.5%.

10. The corrosion-resistant tube of claim 1, wherein the Mo content is 0.5% or more.

11. The corrosion-resistant tube of claim 1, wherein the Si content is not more than 2%.

12. The corrosion-resistant tube of claim 1, wherein the Si content is not more than 0.3%.

13. The corrosion-resistant tube of claim 1, wherein the P content as an incidental purity is not more than 0.015%.

14. The corrosion-resistant tube of claim 1, wherein Si: not more than 2%, Mn: more than 2.5% and not more than 7.5%, and Mo: 0.5% or more with satisfying inequality (2).

15. The corrosion-resistant tube of claim 1, wherein Si: not more than 0.3%, Mo: 0.3% or more, and the content of P as an incidental impurities is not more than 0.015%.

16. The corrosion-resistant tube of claim 1, wherein Si: not more than 2%, Mn: not more than 2.5%, Mo: 0.3% or more with satisfying inequality (1), one or more of Nb, Ti, Zr, and V: 0.1–3% in total.

17. The corrosion-resistant tube of claim 16, wherein the alloy has a grain size equal to or less than ASTM grain size No. 7.

18. A corrosion-resistant heat transfer tube of a heat-recovery boiler which is made of an alloy consisting essentially, on a weight basis, of

| | | | |
|---|---|---|---|
| C: | not more than 0.05%, | Si: | not more than 4%, |
| Mn: | not more than 7.5%, | Ni: | $35 < Ni \leqq 55\%$, |
| Cr: | $25 < Cr \leqq 35\%$, | | |
| Mo: | an amount of at least 0.3% and satisfying the following inequality (1) when $Mn(\%) \leqq 2.5$ or inequality (2) when $2.5 < Mn(\%) \leqq 7.5$, | | |

$$Mo(\%) \leqq 5.8 - [Ni(\%)/10] \quad (1)$$

$$Mo(\%) \leqq 7.5 - [Ni(\%)/10] \quad (2)$$

a balance of Fe and incidental impurities in which the content of P is not more than 0.030% and that of S is not more than 0.010%.

19. A corrosion-resistant heat transfer tube of a heat-recovery boiler which is made of an alloy consisting essentially, on a weight basis, of

| | | | |
|---|---|---|---|
| C: | not more than 0.05%, | Si: | not more than 4%, |
| Mn: | not more than 7.5%, | Ni: | $35 < Ni \leqq 55\%$, |
| Cr: | $25 < Cr \leqq 35\%$, | | |
| Mo: | an amount of at least 0.3% and satisfying the following inequality (1) when $Mn(\%) \leqq 2.5$ or inequality (2) when $2.5 < Mn(\%) \leqq 7.5$, | | |

$$Mo(\%) \leqq 5.8 - [Ni(\%)/10] \quad (1)$$

$$Mo(\%) \leqq 7.5 - [Ni(\%)/10] \quad (2)$$

two or more of Nb, Ti, Zr, and V:0.1–3% in total, one or more of Cu, Co, and W:0–5% in total,

| | |
|---|---|
| N: 0–0.3% | Al: 0–0.5%, |

at least one rare earth metal: 0–0.1% in total, and a balance of Fe and incidental impurities in which the content of P is not more than 0.030% and that of S is not more than 0.010%.

20. The corrosion-resistant tube of claim 18, wherein one or more of Cu, Co, and W are added in an amount of 0.1–5% in total.

21. The corrosion-resistant tube of claim 19, wherein at least one rare earth metal is added in an amount of 0.01–0.1% in total.

22. The corrosion-resistant tube of claim 20, wherein at least one rare earth metal is added in an amount of 0.01–0.1% in total.

23. The corrosion-resistant tube of claim 19, wherein N is added in an amount of 0.1–0.3%.

24. The corrosion-resistant tube of claim 19, wherein A1 is added in an amount of not more than 0.5%.

25. The corrosion-resistant tube of claim 1, wherein an outer surface of the tube is exposed to a high-temperature corrosive environment in a heat-recovery boiler.

26. The corrosion-resistant tube of claim 1, wherein an outer surface of the tube includes chloride-containing fused salts deposited thereon, the fused salts comprising chloride-rich condensates produced in a high-temperature corrosive environment in a heat-recovery boiler in which the tube is located.

27. The corrosion-resistant tube of claim 1, wherein the tube is a superheater tube in a heat-recovery boiler.

* * * * *